US011465382B2

(12) United States Patent
Gonzalez Olmos

(10) Patent No.: US 11,465,382 B2
(45) Date of Patent: Oct. 11, 2022

(54) BOX FORMING MACHINE FOR FORMING BOXES OF DIFFERENT SHAPES AND SIZES

(71) Applicant: TELESFORO GONZALEZ MAQUINARIA, SLU, Elche/Elx (ES)

(72) Inventor: Telesforo Gonzalez Olmos, Santa Pola (ES)

( * ) Notice: Subject to any disclaimer, the term of this patent is extended or adjusted under 35 U.S.C. 154(b) by 0 days.

(21) Appl. No.: 17/344,771

(22) Filed: Jun. 10, 2021

(65) Prior Publication Data

US 2021/0387435 A1 Dec. 16, 2021

(30) Foreign Application Priority Data

Jun. 10, 2020 (EP) ..... 20382502

(51) Int. Cl.

| | |
|---|---|
| ***B31B 50/62*** | (2017.01) |
| ***B31B 50/26*** | (2017.01) |
| ***B31B 50/00*** | (2017.01) |
| ***B31B 50/80*** | (2017.01) |
| ***B31B 50/52*** | (2017.01) |
| *B31B 120/30* | (2017.01) |
| *B31B 100/00* | (2017.01) |
| *B31B 110/35* | (2017.01) |

(52) U.S. Cl.

CPC ..... *B31B 50/624* (2017.08); *B31B 50/006* (2017.08); *B31B 50/262* (2017.08); *B31B 50/52* (2017.08); *B31B 50/802* (2017.08); *B31B 2100/00* (2017.08); *B31B 2110/35* (2017.08); *B31B 2120/30* (2017.08)

(58) Field of Classification Search

CPC ..... B31B 50/006; B31B 50/262; B31B 50/52; B31B 50/802; B31B 2120/30; B31B 2100/00; B31B 3110/35

USPC ..... 493/7, 126, 131, 141, 167, 128, 151

See application file for complete search history.

(56) References Cited

U.S. PATENT DOCUMENTS 4,022,116 A 5/1977 Frappier
4,430,147 A * 2/1984 Harston ..... B31B 50/622 118/259

(Continued)

FOREIGN PATENT DOCUMENTS

ES 2660059 A1 3/2018
ES 2749298 A1 3/2020

*Primary Examiner* — Andrew M Tecco
*Assistant Examiner* — Jacob A Smith
(74) *Attorney, Agent, or Firm* — Eugenio J. Torres-Oyola; Victor M. Rodriguez-Reyes; Rafael Rodriguez-Muriel

(57) ABSTRACT

The present invention relates to a box forming machine for forming boxes of different shapes and sizes, comprising a forming station including an operating space, demarcated by upper and lower devices and receiving a box during the forming thereof, without horizontal movement of said box; flexible, pressurizable, and heatable glue conduits connected to a plurality of glue application nozzles, configured for being positioned in different positions consistent with the size of the box to be formed, and at least one electrically-operated valve configured for applying said hot glue in respective relative positions of said glue application nozzles with respect to the box, according to operative parameters associated with the dimensions of the box to be formed, including dimensions of upper and lower flaps of said box and at least one working temperature of a hot glue to be applied previously input in a user interface connected to a control device.

14 Claims, 20 Drawing Sheets

(56) References Cited

U.S. PATENT DOCUMENTS

| | | | | |
|---|---|---|---|---|
| 5,971,906 | A * | 10/1999 | Tharpe, Jr. ..... | B65D 71/0096<br>493/131 |
| 2004/0161531 | A1 * | 8/2004 | Ferber ..... | B05C 11/1005<br>118/688 |

* cited by examiner

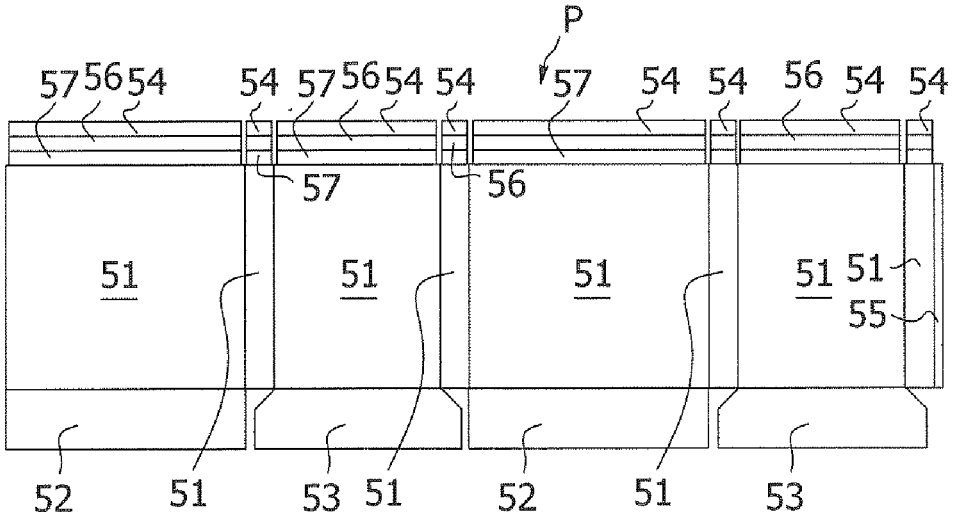
Fig. 8
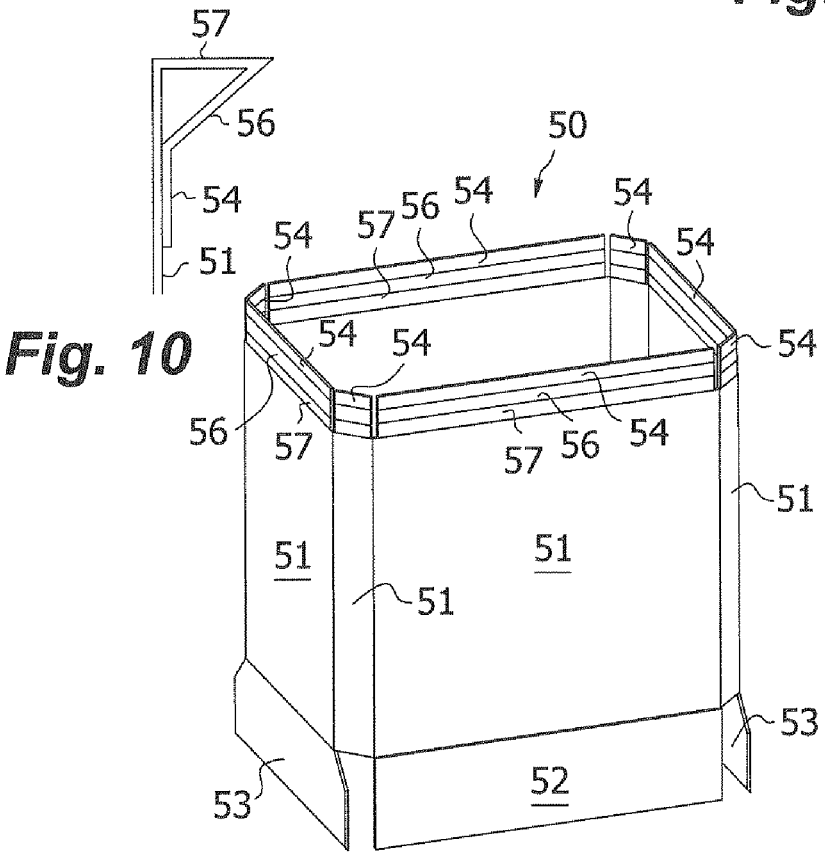
Fig. 10
Fig. 9

BOX FORMING MACHINE FOR FORMING BOXES OF DIFFERENT SHAPES AND SIZES

TECHNICAL FIELD

The present invention relates to a box forming machine for forming boxes of different shapes and sizes, useful for forming boxes with a rectangular or octagonal configuration with a completely or partially closed bottom and an open upper part provided with a reinforced edge from a plurality of boxes that are folded and stacked in the vertical position.

State of the Art and Technical Problem to be Solved

Boxes with a rectangular or octagonal configuration having side walls, a completely or partially closed bottom formed by several flaps extending from lower edges of the side walls bent and glued to one another, and an open upper part demarcated by upper edges of the side walls, are known.

When producing such boxes, to facilitate transport and storage, it is common to have a plurality of boxes that are folded and stacked which must be individually unfolded and formed to the mentioned rectangular or octagonal configuration with the bottom completely or partially closed and the upper part open. The folded boxes can be stacked in the horizontal or vertical position.

Each box is made up of a die-cut sheet made of corrugated cardboard or the like and provided with scored lines defining a plurality of panels corresponding to the side walls and to the lower flaps, wherein the panels corresponding to the side walls are connected to one another at their side edges forming a strip, and wherein the side edges of the first and last panels of the strip are likewise connected to one another such that the strip constitutes a closed ring.

In the folded position, the closed ring is flattened such that one half of the panels are superimposed on the other half of the panels. In the folded position, and depending on the configuration of the box, it is common for the scored lines defining one half of the panels not to coincide with the scored lines defining the other half of the panels.

Once boxes of this type, referred to as "pallet boxes" or "bulk boxes", have been formed, they are stackable, but they are usually not stacked directly on top of one another but rather each box is arranged on a pallet forming a box and pallet assembly, and the box and pallet assemblies are stacked on top of one another. The compression strength required of the box in the vertical direction is high and the flutes of the corrugated cardboard are oriented in the vertical direction, and wherein the box optionally has an octagonal configuration for this purpose. Since the compression and expansion strength required of the box is high, it is appropriate to furthermore provide reinforcement on the upper edges of the side walls along the open upper part.

This upper reinforcement can be provided by equipping the box with upper flaps extending from the upper edges of the side walls and folding and gluing these flaps against an inner surface of the side walls for the purpose of doubling the thickness of the material of the side walls along a band adjacent to the open upper part of the box.

Document ES2660059A1 discloses a box forming machine comprising a support structure, a folded box storage area configured for receiving a plurality of boxes that are folded and stacked in the vertical position, a forming station configured around a vertical axis and including an operating space sized to receive a box during the forming thereof, an unfolding device that can be operated for holding a box from the folded box storage area and unfolding it into a rectangular configuration and placing it in an intermediate station, and a translation device that can be operated to move the box in the rectangular configuration from the intermediate station and to the operating space of the forming station.

The machine described in said document ES2660059A1 furthermore has a lower forming device having lower flap folding devices configured for folding lower transverse and longitudinal flaps of the box during the translation thereof from the intermediate station to the operating space, and a hold-down plate located in the forming station above the operating space, wherein the hold-down plate can be operated to move along a path aligned with the vertical axis between a position outside the operating space and a position within the operating space so as to press the lower transverse and longitudinal flaps of the box, to which glue was previously applied, against the lower flap folding devices.

A drawback of the machine described in said document ES2660059A1 is that it does not include an upper flap folding device which allows folding upper flaps so as to provide the box with additional reinforcement along a band of the side walls of the box adjacent to the open upper part.

Another drawback of the machine described in said document ES2660059A1 is that the arrangement of the intermediate station and the configuration of the lower flap folding devices for folding the lower transverse and longitudinal flaps of the box during the translation of the box from the intermediate station to the operating space means that the dimensions of the machine are quite considerable and that the machine is particularly bulky.

Moreover, the U.S. Pat. No. 4,022,116A discloses a box forming machine which, again, requires a previously unfolded box to be moved so as to apply glue on two opposite upper flaps of a box with a rectangular configuration. U.S. Pat. No. 4,022,116 only allows glue to be applied on two opposite flaps while moving the box, and furthermore the nozzles 101, 102 are spaced from said flaps and apply horizontal glue beads in correspondence with the horizontal movement of the box 91 pushed by the wall 65, all this resulting in the application of glue being limited to two flaps and with possible imprecisions, first, because it is applied to a moving box 91 which may present irregularities, and secondly because said glue beads are applied with a relatively large distance between each nozzle and its corresponding flap due to the high arrangement of the nozzles so as to allow said horizontal movement of the box 91.

Document ES2749298A1 describes a box forming machine comprising a forming station with an operating space sized to receive a box during the forming thereof, without any horizontal movement of the box and forming devices, configured for forming the box in said operating space comprising:

- an upper forming device located above the operating space equipped with an upper vertical member movably operated on a path vertical, between a working position within the operating space and a standby position outside the operating space;
- an upper folding device support that can be operated to move along a vertical path between an inoperative position outside the operating space and an operative position within the operating space,
- at least four folding devices for folding upper flaps of the box, facing one another in pairs, installed in the upper folding device support and can be operated for folding the upper flaps of the box to which glue was previously applied, and pressing them against inner surfaces of the side walls of the box;

a plurality of glue application nozzles for applying glue according to operative parameters indicative of at least one glue application start and end position, by a relative movement between said plurality of glue application nozzles and said box according to a predetermined path, said movement being provided by at least said upper forming device, an auxiliary device, or a lower glue device, and said glue being applied on inner surfaces of upper transverse or longitudinal flaps of the box, and/or of lower transverse or longitudinal flaps of the box, located above and/or below the operating space, respectively, advantageously in the form of glue beads, a lower forming device located below the operating space and comprising a plurality of lower flap folding devices facing one another in pairs around the vertical axis Z, configured for folding lower transverse and longitudinal flaps of the box to which glue was previously applied, from a vertical position to a horizontal position, and a hold-down plate supported in said upper vertical member, movable along a path aligned with the vertical axis Z between an inactive position outside the operating space and an active position within the operating space adjacent to said lower flap folding devices, so as to press said lower transverse and longitudinal flaps to which glue was previously applied against same.

Optionally, but in a preferred manner, this machine also proposes side bearing walls with faces that are parallel to the vertical axis Z defining a contour that can be inserted into said box in the unfolded position and arranged so as to exert counter-pressure on inner surfaces of the side walls of the box during the forming thereof.

In the machine described in document ES2749298A1, the arrangement of the vertically movable nozzles inside the upper flaps of the box to be formed complicates the development of the forming machine and its manufacturing cost. First, there are a large number of glue application nozzles, and their glue supply and electrical supply connections for applying said glue beads determine a complex assembly. Secondly, the inner dimensions of the box to be formed are limited and/or reduced.

It follows from the foregoing that a machine capable of forming boxes with the largest possible measurement variations for boxes with both large and small dimensions, reducing costs of the machine itself and box forming operating costs, is required.

BRIEF DISCLOSURE OF THE INVENTION

The present invention largely mitigates the foregoing and other drawbacks by providing a box forming machine with features as defined in claim 1. An adjustable forming machine for forming boxes which allows being adapted in an automated manner (and with minimal intervention by an operator) is thereby provided for forming boxes having a wide range of sizes and configurations, particularly with a square, octagonal, or dodecahedral-shaped polygonal contour, in a minimal space, in a single forming station, and not in several forming stations, have a low number of elements, and therefore constituting a cost-effective and compact production unit.

The machine is configured for folding lower flaps, for closing the bottom of the box and upper flaps, for providing reinforcement.

For this purpose, the box forming machine incorporates a gluing technology including flexible, pressurizable, and heatable glue conduits, integrating for example a heater, which relocate the positions of the proximal end thereof to the changing position of upper and lower glue application nozzles finishing an end of those glue conduits, these glue application nozzles being movable according to a predetermined path, particularly aligned with a vertical axis or with a linear axis (for the lower flaps of the box), even in the event of changes in size, for example, in the width and/or length of the box to be formed. The glue that is supplied can be melted using resistors and its temperature is controlled by temperature sensors.

The machine integrates a control device for monitoring the temperature of the glue in the glue supply reservoir and in the mentioned conduits, including a programmable control device which is connected to all the parts imparting movement to the components of the machine, particularly those included in the upper and lower forming devices, including the actuator of the upper vertical member supporting the hold-down plate and the mentioned optional side bearing walls with faces parallel to the vertical axis Z defining a contour that can be inserted into said box during the forming thereof, folding devices for folding upper and lower flaps, and glue application nozzles.

Preferably, the actuator of said upper vertical member comprises a rotary motor coupled to an encoder, said motor and encoder assembly being configured for moving the hold-down plate a desired linear length (with a high precision) along said path aligned with said vertical axis Z to a desired active and/or inactive position.

The mentioned electronic glue control device is additionally configured for sending to said programmable control device at least one signal indicative of a change in the temperature (and/or glue pressure) conditions in the glue reservoir and in the mentioned flexible conduits, by at least several temperature sensors, when said sensors have detected working temperature values related to operative parameters.

The features of the invention, particularly the actuation bodies and arrangement for moving the plurality of upper and lower glue application nozzles, folded box storage area, and elements for discharging the formed boxes, as well as others, will be explained in detail below in reference to illustrative drawings of different embodiments.

BRIEF DESCRIPTION OF THE DRAWINGS

Therefore, to complement the description of the object of the present invention and to help better understand the features which distinguish it, drawings are attached in which the following has been depicted in an illustrative and non-limiting manner:

FIG. 8 is a view of a third sheet format which can be folded so as to form an eight-sided closed contour;

FIG. 9 is a top perspective view of the unfolded eight-sided box obtainable with the sheet of FIG. 7;

FIG. 10 is a detail view of the formed reinforced upper opening of the box of FIG. 9, showing the upper flaps of the box, to which glue was previously applied, adhered against an inner or an outer surface of the side walls of the box;

DETAILED DISCLOSURE OF THE EMBODIMENTS

Figure 2:
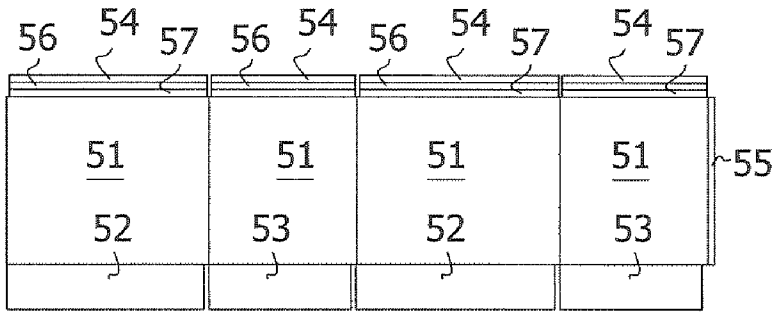
FIG. 2 is a view of a first sheet format which can be folded so as to form a four-sided closed contour.

For all the described embodiments, the box forming machine 200 for forming boxes of different shapes and sizes comprises a support structure 23, incorporates an optional folded box storage area 1, and a forming station 5.

The optional folded box storage area 1 is configured for receiving a plurality of boxes 50 that are folded and stacked in the vertical position. Said forming station 5 is configured around a vertical axis Z and comprises forming devices preferably supported in said support structure (23) and configured for forming the box 50 in said operating space 28, among which there are an upper forming device 6 supported in the support structure 23 and a lower forming device 24. Said forming station 5 includes an operating space 28 located between the upper forming device 6 and the lower forming device 24. The operating space 28 is sized to receive a box 50 during the forming thereof in the forming station 5 without horizontal movement of the box.

Figure 5:
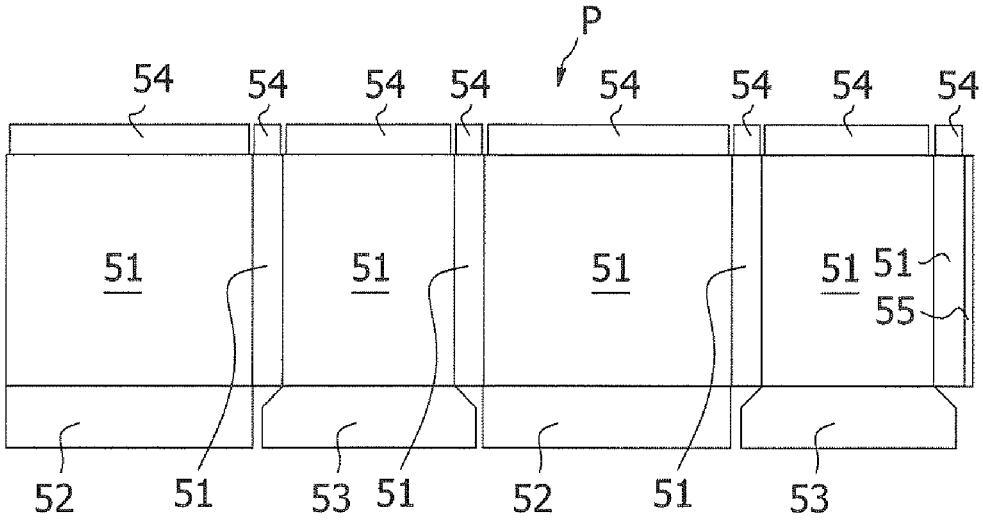
FIG. 5 is a view of a second sheet format which can be folded so as to form an eight-sided closed contour.

FIGS. 2, 5, and 8 show different die-cut sheets P of corrugated cardboard or the like corresponding to the net of respective boxes 50 susceptible to being formed with the machine 200 according to the present invention. Said sheet P comprises scored lines defining a plurality of panels corresponding to side walls 51 and to lower and upper flaps 52, 53, 54.

Figure 4:
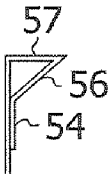
FIG. 4 is a detail view of the formed reinforced upper opening of the box of FIG. 3, showing the upper flaps of the box, to which glue was previously applied, adhered against an inner or an outer surface of the side walls of the box.
Figure 7:
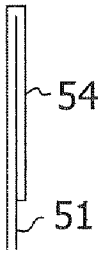
FIG. 7 is a detail view of the formed reinforced upper opening of the box of FIG. 5, showing the upper flaps of the box, to which glue was previously applied, adhered against an inner or an outer surface of the side walls of the box.

The panels of the die-cut sheet include four or eight side walls 51 connected consecutively at their side edges forming a strip, although according to another example they may also include twelve side walls 51 which, when formed, adopts a dodecagonal configuration. Four lower flaps, two longitudinal flaps 52 and two transverse flaps 53, extend from lower edges of side walls 51. In FIGS. 2 to 10, four or eight upper flaps 54 extend from upper edges of the side walls 51. In FIGS. 2 to 4 and 8 to 10, between the upper edges of the side walls 51 and said upper flaps 54 there is a series of consecutive intermediate flaps 56, 57 providing a triangular upper reinforcement for the open opening of the formed box 50, as shown in FIGS. 4 and 10. Said reinforcement may be square (not shown) or a reinforcement in which said upper flaps 54 are adhered to the inside of the side walls 51 forming double walls, as shown in FIG. 7.

Figure 3:
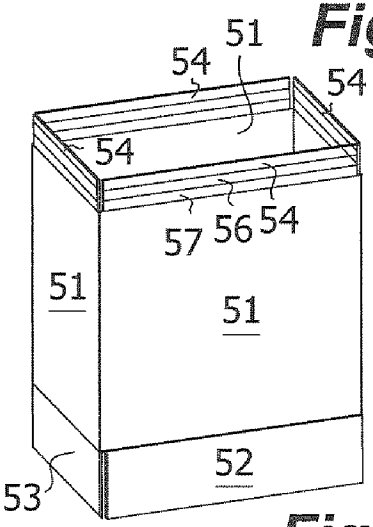
FIG. 3 is a top perspective view of the box with an unfolded square configuration obtainable with the sheet of FIG. 2.
Figure 1:
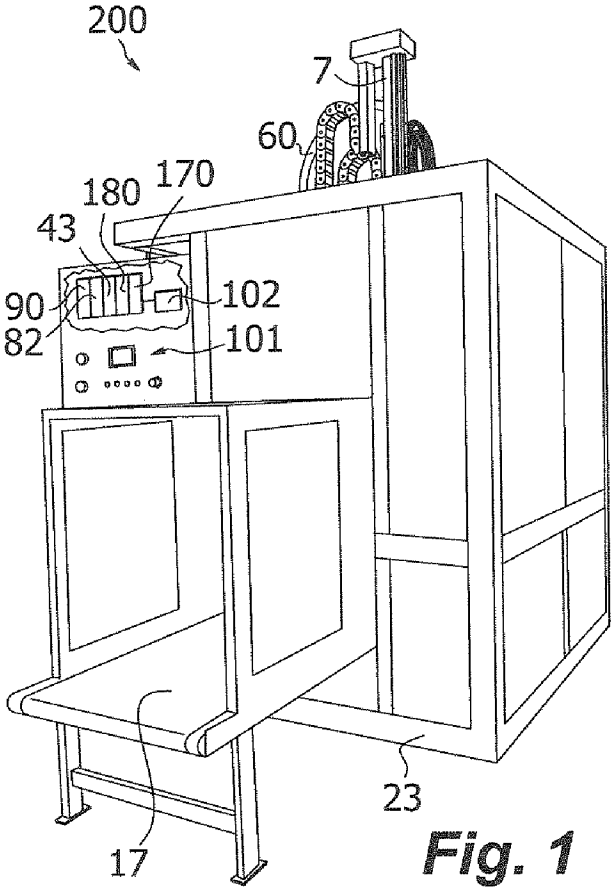
FIG. 1 is a front perspective view from the front of the box forming machine of the present invention according to a first preferred embodiment.
Figure 6:
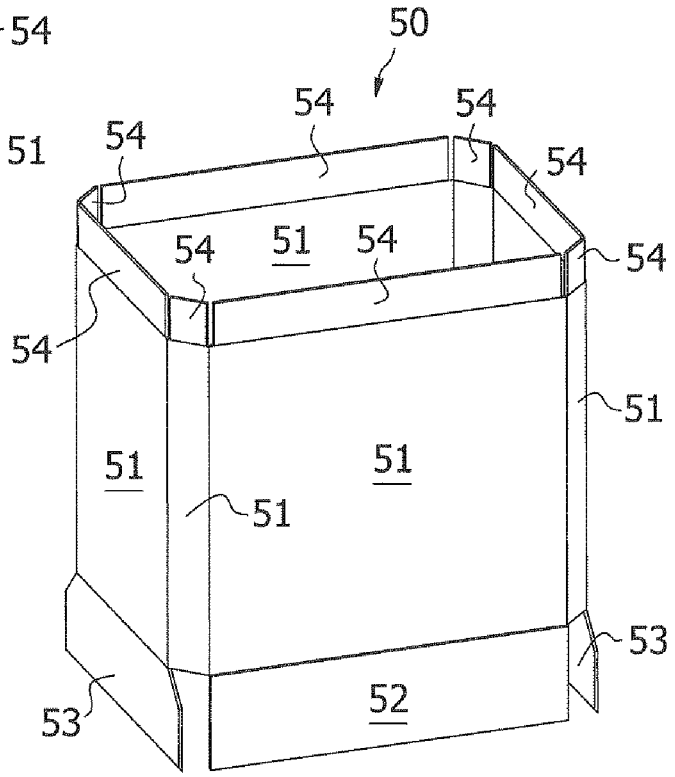
FIG. 6 is a top perspective view of the box with an unfolded eight-sided configuration obtainable with the sheet of FIG. 5.

Going back to FIGS. 2, 5, and 10, from a side edge of one of the side walls 51 located at one end of the strip there extends an attachment tab 55 provided for being attached, for example by adhesive, to the side edge of another one of the side walls 51 located at the other end of the strip such that the strip of the die-cut sheet P constitutes a closed ring with a rectangular or octagonal configuration, as shown in FIGS. 3, 6, and 9. Optionally, said closed rings may have an essentially rhomboidal and/or rectangular configuration before adopting said octagonal configuration.

Figure 11:
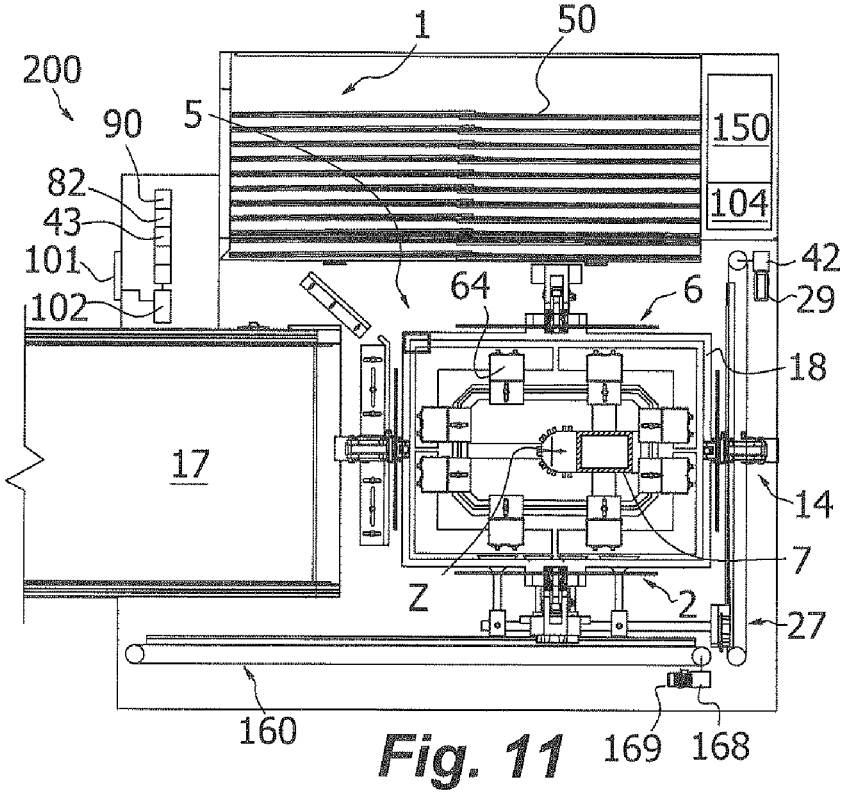
FIG. 11 is a schematic cutaway plan view of the machine of FIG. 1, sectioned along a horizontal plane and according to a first embodiment suitable for forming the four-sided box of FIG. 3.

The closed ring of each box 50, when arranged in the folded position in the folded box storage area 1, is flattened such that half of the panels are superimposed on the other half of the panels, as shown in FIG. 11. Given that the panels corresponding to the side walls 51 have different widths in the example shown, the vertical scored lines defining half of the panels do not coincide with the vertical scored lines defining the other half of the side walls 51.

To form the box 50 from the closed ring of FIG. 11, it is necessary, for example, to apply glue on outer surfaces of the lower longitudinal flaps 52 and/or of the lower transverse flaps 53, consecutively fold the lower longitudinal and transverse flaps 52, 53, and press them against one another so as to attach them together and form a completely or partially closed bottom.

For the case of the boxes of FIGS. 3, 6, and 9, it is also necessary to apply glue on inner surfaces of the upper flaps 54, fold the upper flaps 54 inwardly, and press them against inner surfaces of the side walls 51 (FIGS. 4, 7 and 10) so as to form a reinforcement along a band of the side walls 51 adjacent to an open upper part of the box 50.

Alternatively, for the case of the boxes of FIGS. 3, 6, and 9, said upper flaps 54 may be folded outwardly and pressed against outer surfaces of the side walls 51 (FIGS. 4, 7 and 10) so as to form a reinforcement along a band of the side walls 51 adjacent to an open upper part of the box 50.

Figure 20:
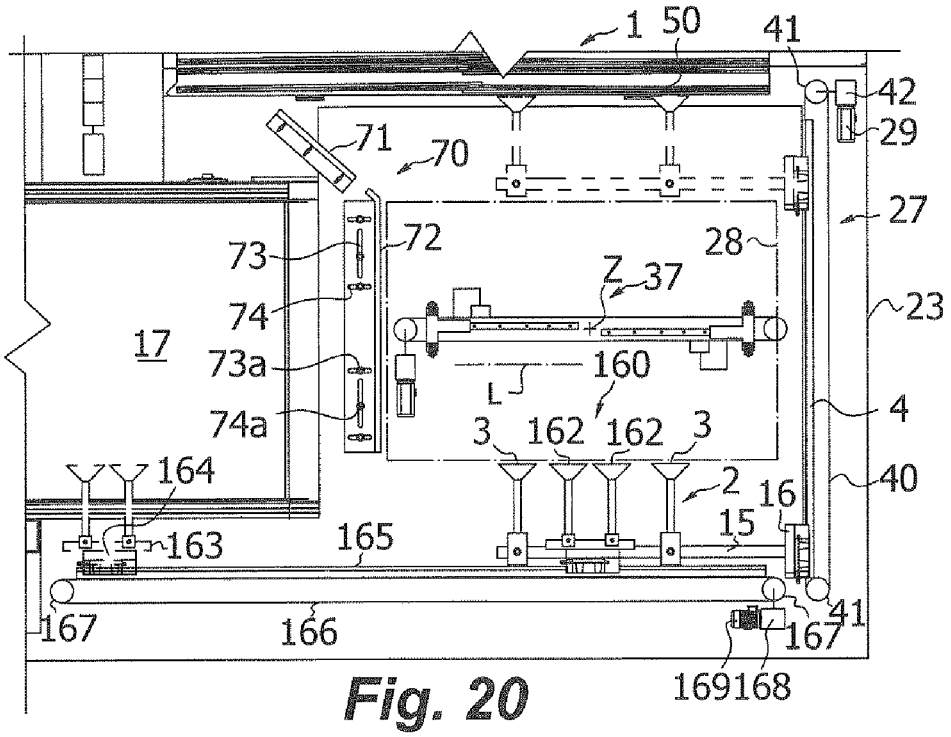
FIG. 20 is a schematic plan view of the machine of the first embodiment, sectioned according to another horizontal plane, in which some devices in their other operating positions have been depicted in a discontinuous line.
Figure 21:
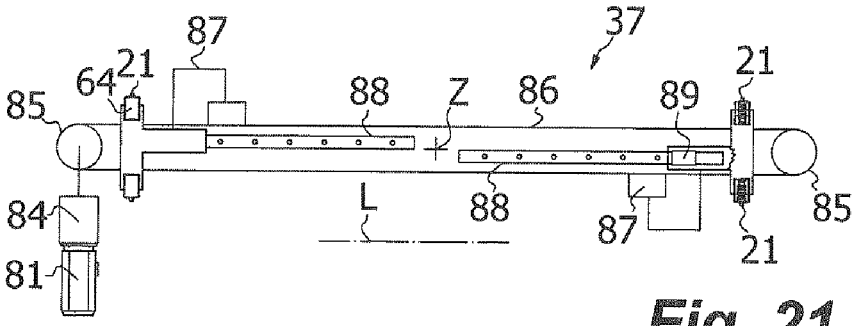
FIGS. 21 and 22 show respective schematic views of the lower glue device, with said lower glue application nozzles in a start position in one view and in an end position in the other view, according to said first embodiment.
Figure 22:
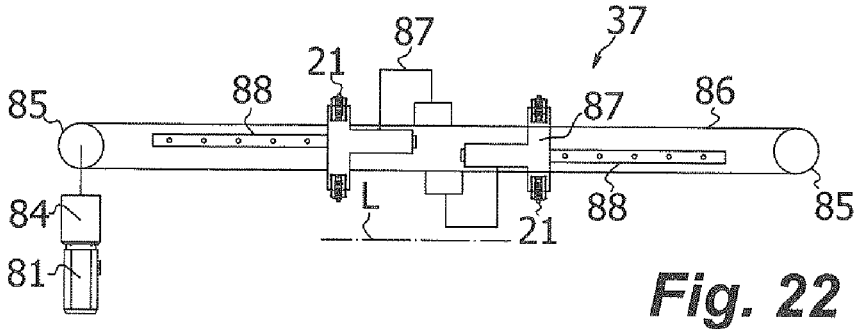
Figure 23:
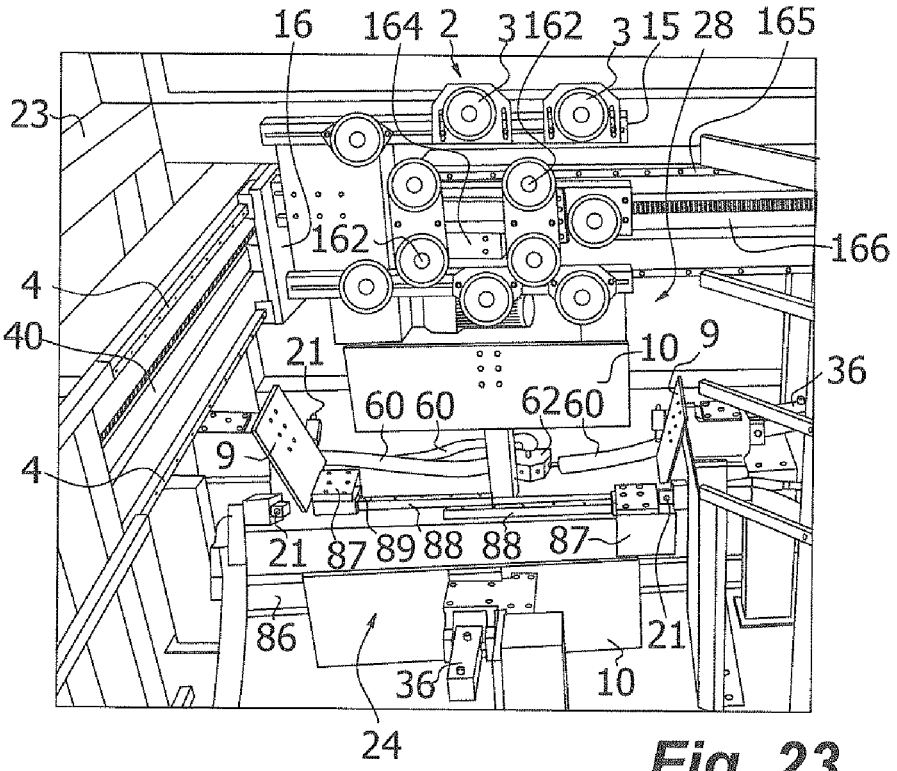
FIG. 23 is a detailed perspective view of the part lower of the operating space from the side of the operating space of the sheet storage area according to said first embodiment.
Figure 28:
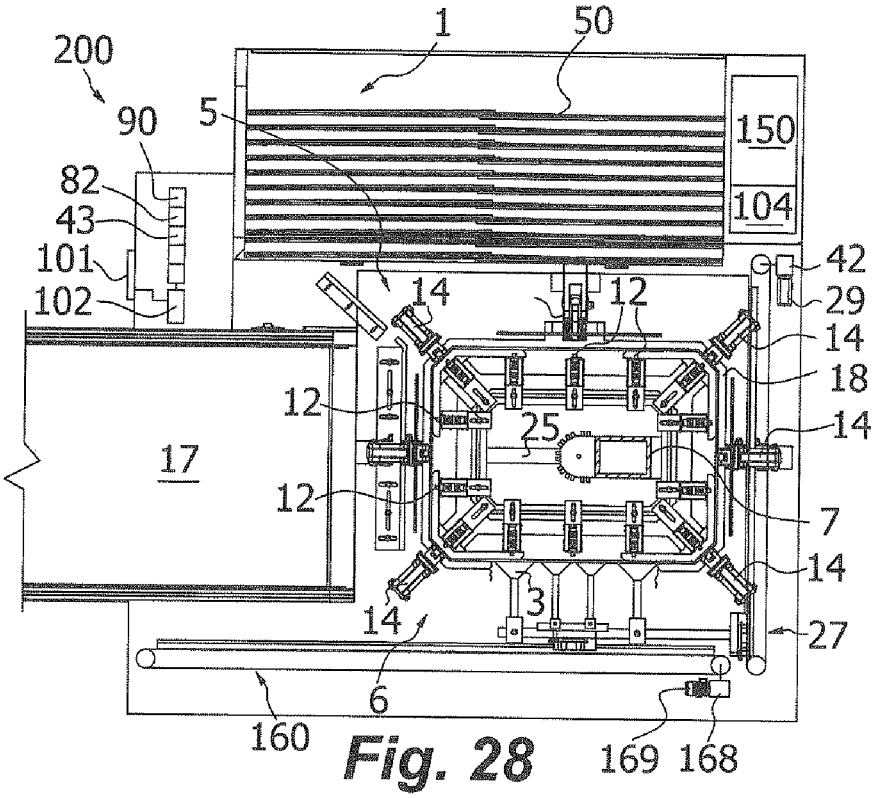
FIG. 28 is a schematic cutaway plan view of the machine of FIG. 1, sectioned along a horizontal plane, and according to a third embodiment suitable for forming any of the octagonal boxes of FIGS. 6 and 9.

FIGS. 11, 20, and 28 show that in any of its embodiments, said machine 200 preferably includes a positioning device including a gripping body 2 provided with suction cups 3 configured for holding at least one side wall 51 of the box 50, a secondary rotary motor 29 configured for moving said gripping body 2 between a lateral side of the operating space 28 for the inlet of folded or unfolded boxes, and another position adjacent to another lateral side of the operating space 28, for holding and placing an unfolded box 50 with an essentially rhomboidal or rectangular configuration in the operating space 28 of the forming station 5.

In any of its embodiments, said machine 200 preferably includes a secondary encoder 44 coupled to said secondary rotary motor 29, said secondary encoder and secondary rotary motor 44, 29 assembly being configured for positioning said side wall 51 of said box 50 vertically in a desired position with respect to said vertical axis Z, consistent with at least one operative parameter of a position according to a predetermined auxiliary path input in said user interface 101, 107, for adapting the machine to different sizes of the box 50.

Said machine 200 furthermore optionally includes an unfolding and translation device 27 for holding a box 50 from the folded box storage area 1, unfolding it and placing the unfolded box 50 in an essentially rhomboidal or rectangular configuration in the operating space 28 of the forming station 5.

FIGS. 11, 20, 24, and 28 show that said unfolding and translation device 27 includes said positioning device. In said unfolding and translation device 27, said gripping body 2 provided with suction cups 3 is supported by an arm 15 connected to a carriage 16 coupled along at least one transverse guide 4, said carriage 16 being attached to an endless secondary flexible transmission element 40 assembled on two secondary pulleys 41, one of which is coupled to a secondary reduction gear 42, in turn coupled to a secondary rotary motor 29, configured for moving said gripping body 2 between a lateral position adjacent to said folded box storage area 1 and a position adjacent to one side of the operating space 28, preferably opposite the folded box storage area 1, for holding a box 50 of the folded box storage area 1, unfolding it, and placing the unfolded box 50 in an essentially rhomboidal or rectangular configuration in the operating space 28 of the forming station 5.

In the specific example of the figures, the boxes enter on the inlet side of the operating space 28 in the folded form since they are unfolded as they are positioned by said positioning device or by the unfolding and translation device 27 within the operating space 28 relative to the vertical axis Z.

Figure 18:
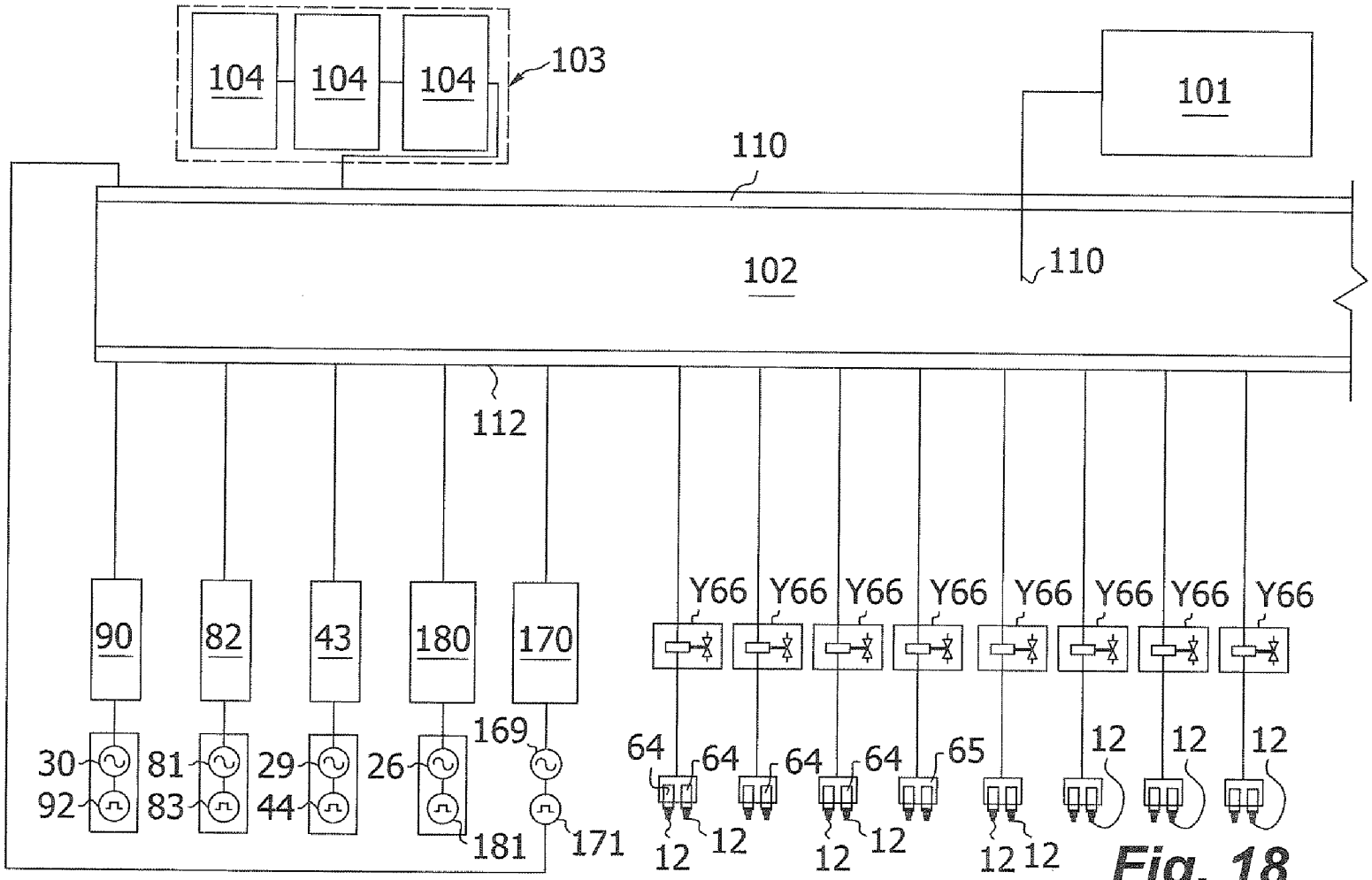
FIGS. 18 and 19 are respective parts of a wiring diagram of the control device of the machine showing the connections to the different elements integrated in the machine of the present invention according to said first embodiment.
Figure 27:
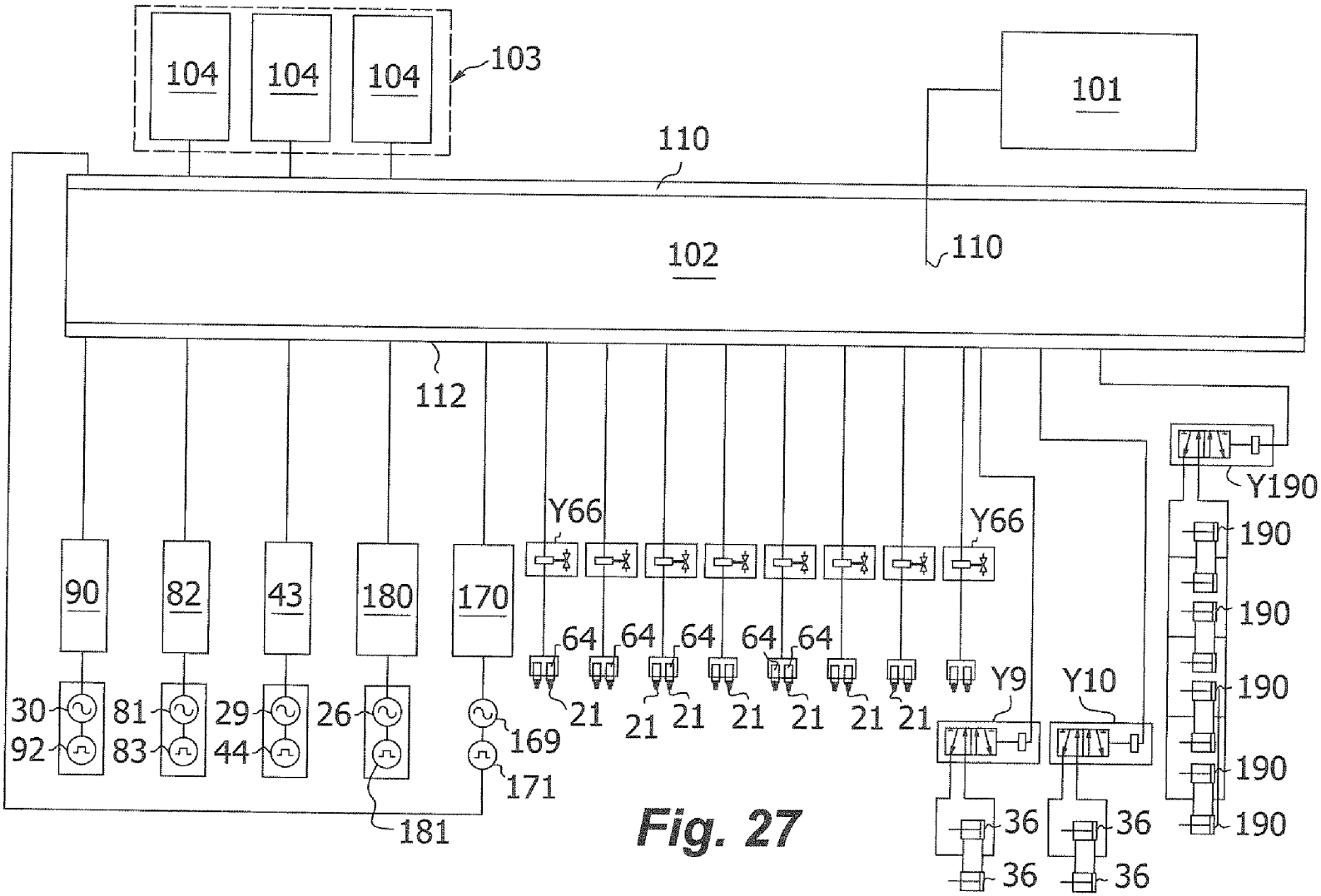
FIG. 27 is a wiring diagram of the control device of the machine showing the connections to the different elements integrated in the machine of the present invention according to said second embodiment.
Figure 33:
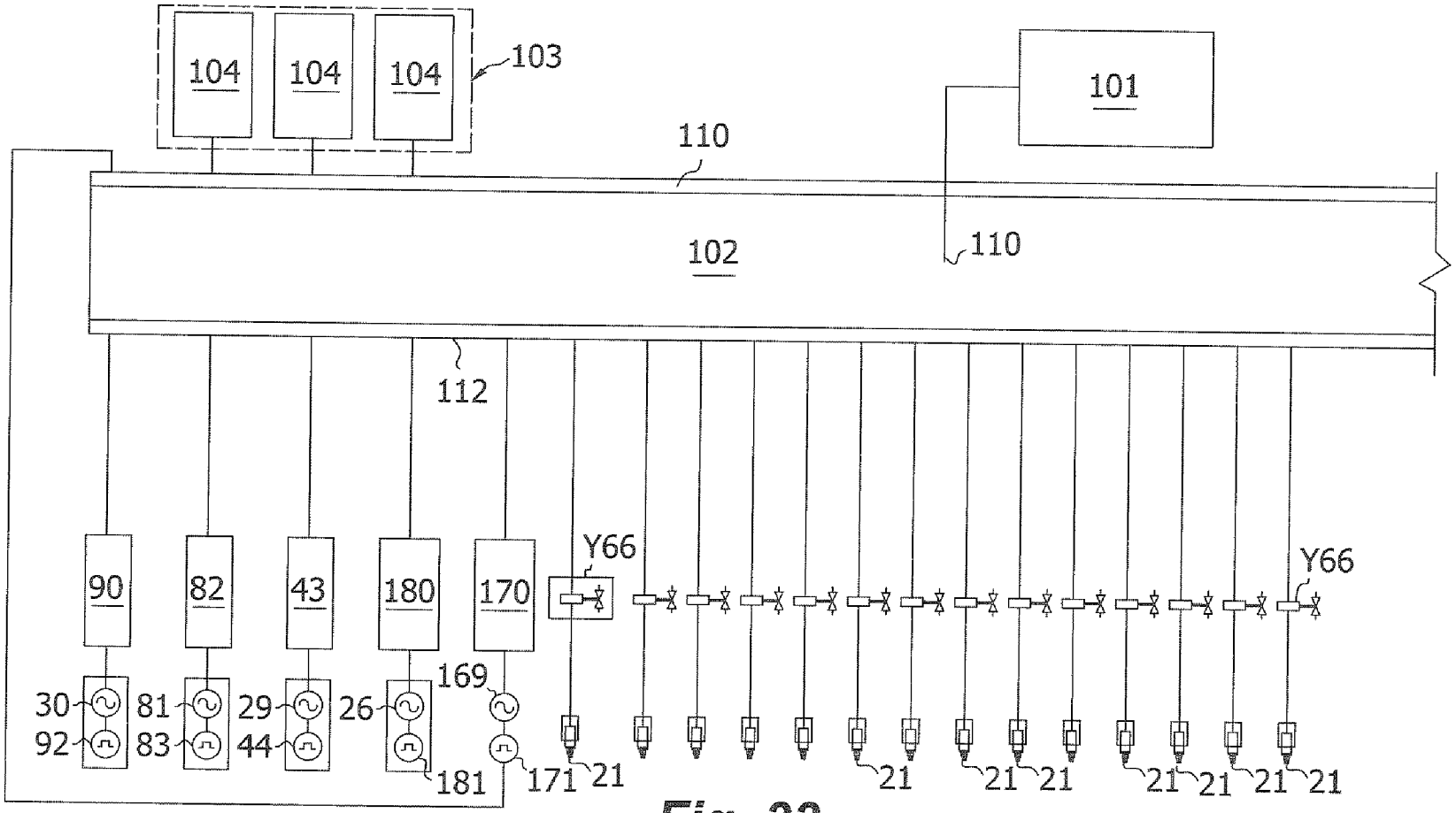

FIGS. 18, 27, and 33 show that said secondary encoder and secondary rotary motor 44, 29 assembly is configured for translating, preferably transversely, said box 50 according to said predetermined auxiliary path aligned with a desired linear length, consistent with at least one operative parameter of a position along said preferred transverse direction, previously input in said user interface 101, 107.

Preferably, said unfolding and translation device 27 is configured so that the box 50 is unfolded and positioned with respect to said vertical axis Z of the forming station 5 in a single operation.

Figure 24:
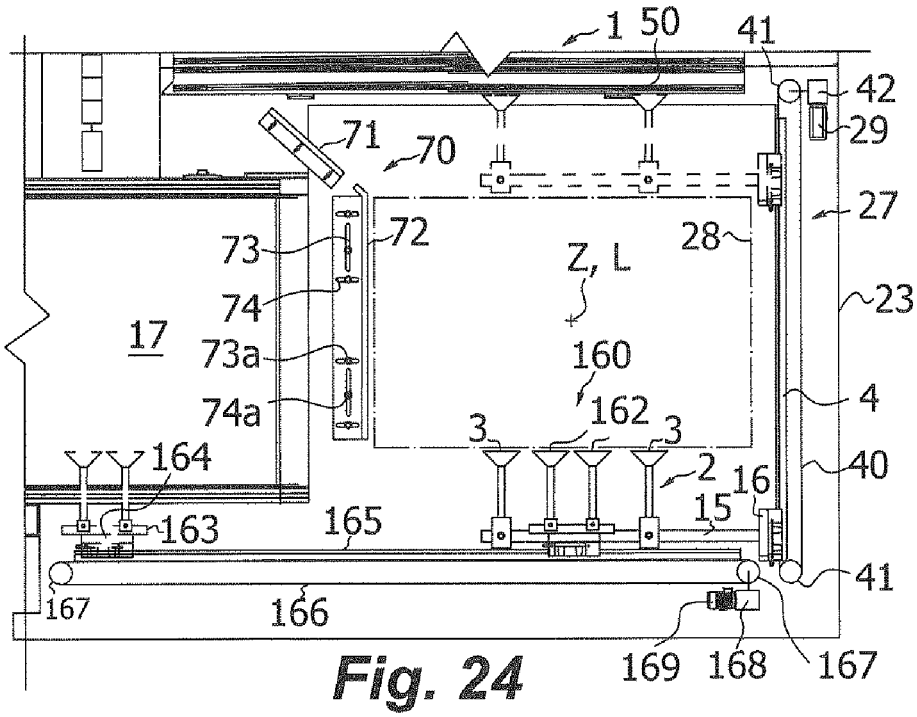
FIG. 24 is a cutaway plan view of the machine of FIG. 1, sectioned along a horizontal plane, and according to a second embodiment.

FIGS. 11, 20, and 24 show that said machine 200 optionally includes an auxiliary unfolding device 70 equipped with a first inclined vertical surface 71 with respect to a second straight vertical surface 72, adjacent to one side of the operating space 28, configured for cooperating with the unfolding and translation device 27 during the unfolding and positioning of the box within the operating space 28. Said auxiliary unfolding device 70 is equipped with positioning device 73, 74, **73*a*, 73*b* for positioning said first and/or second surfaces 71, 72 with respect to said unfolding and translation device 27 according to a transverse and/or longitudinal horizontal direction. Namely, said positioning device are grooves 73, 74 made in a horizontal portion of said surfaces 71, 72 according to transverse and longitudinal horizontal directions, and blocking elements such as screws 73*a*, 73*b* which block and unblock said first and second surfaces 71, 72 with respect to the support structure 23 so as to adapt said machine 200 to the sizes of the box 50** to be formed.

Once the partially open or closed bottom of the lower flaps 52, 53 of the box 50 and the reinforcement of the upper flaps 54 have been formed, the box 50 can be discharged from the operating space 28 by an ejection device 160. To that end, the rotary motor and encoder 30, 92 assembly moves said hold-down plate 8 to a desired inactive position in which the hold-down plate 8 is located above the upper part of the formed box 50, the machine 200 being adapted to boxes 50 with changing measurements (heights).

FIGS. 11, 20, and 24 show that said machine 200 is optionally equipped with the mentioned ejection device 160 for ejecting the formed box 50, including a complementary gripping body 161 provided with complementary suction cups 162, supported by a complementary arm 163 connected to a complementary carriage 164 coupled along a horizontal longitudinal guide 165 supported in the support structure 23, optionally extending along the side of the operating space 28 opposite the box storage area 1. Said complementary carriage 164 is attached to an endless complementary flexible transmission element 166 assembled on two complementary pulleys 167, one of which is coupled to a complementary reduction gear 168, coupled to a complementary rotary motor 169, in turn coupled to a complementary encoder 171.

Said complementary rotary motor and complementary encoder 169, 171 assembly is configured for moving said complementary gripping body 161 from the mentioned side of the operating space 28 opposite the folded box storage area 1, to an ejection position on a belt 17 optionally equipped with driver, such as a conveyor rotary motor, for ejecting said formed box 50 from within the operating space 28, and placing it outside the operating space 28 of the forming station 5.

In all the described embodiments, said upper forming device 6 is located in the forming station 5 above the operating space 28 and arranged relative to a vertical axis Z, comprising:

an upper vertical member 7 movably operated by an actuator on a path aligned with said vertical axis Z, between a working position within the operating space, and a standby position outside the operating space 28;

an upper folding device support 18 that can be operated to move along said path aligned with the vertical axis Z between an inoperative position outside the operating space 28 and an operative position within the operating space 28, or fixed in said upper forming device 6, and at least four folding devices 14 for folding upper flaps 54 of the box, facing one another in pairs, installed in the upper folding device support 18 or in the support structure 23 and can be operated for folding the upper flaps 54 of the box 50 to which glue was previously applied, and pressing them against inner or outer surfaces of the side walls 51 of the box 50.

In the figures, said upper folding devices 14 can be operated for folding the upper flaps 54 of the box 50 to which glue was previously applied, and pressing them against inner surfaces of the side walls 51 of the box 50.

In all the described embodiments, FIGS. 11 to 34 show that said machine 200 further comprises:

a plurality of glue application nozzles 12, 21 arranged for applying glue according to operative parameters indicative of at least one glue application start and end position of said glue application nozzles 12, 21, by a relative movement between said plurality of glue application nozzles 12, 21 and said box 50 according to a predetermined path, said movement being provided by at least said upper forming device 6, an auxiliary device 180, or a lower glue device 37 of the forming station 5, and being arranged for applying said glue on outer or inner surfaces of upper transverse and longitudinal flaps 54 of the box, and/or of lower transverse or longitudinal flaps 52, 53 of the box, located above and/or below the operating space 28, respectively, advantageously in the form of glue beads, a lower forming device 24 of the forming station 5 located in the forming station 5 below the operating space 28 and arranged relative to the vertical axis Z, comprising a plurality of lower flap folding devices 9, 10 facing one another in pairs around the vertical axis Z, configured for folding lower transverse and longitudinal flaps 52, 53 of the box 50 to which glue was previously applied, from a vertical position to a horizontal position, and a hold-down plate 8, supported in said upper vertical member 7, movable along a path aligned with the vertical axis Z between an inactive position outside the operating space 28 and an active position within the operating space 28 adjacent to said lower flap folding devices 9, 10, so as to press said lower transverse and longitudinal flaps 52, 53 to which glue was previously applied against same.

Likewise, FIGS. 14 to 16, 25, 30, and 32 show that said machine 200 comprises flexible, pressurizable, and heatable glue conduits 60 connected between a glue reservoir 150 and said plurality of upper glue application nozzles 12 and/or lower application nozzles 21. Said reservoir 150 integrates reservoir heater 151 for heating and melting glue and a temperature sensor 152 for controlling said heater 151. Said plurality of upper glue application nozzles 12 and/or lower glue application nozzles 21 are configured for being positioned in different positions consistent with the size of the box to be formed for applying glue on outer or inner surfaces of said upper flaps 54 and lower transverse flaps 52 and/or longitudinal flaps 53. Said plurality of upper glue application nozzles 12 and/or lower glue application nozzles 21 are connected with respective hot glue injectors 64 associated with a respective heating resistor 153 and a respective temperature sensor 152.

For all the embodiments, in FIGS. 1, 14 to 19, 25, 27, and 31 to 33, said machine 200 comprises at least one electrically-operated valve Y66 connected in said control device and associated with said hot glue injectors 64, configured for opening and closing a glue passage joining said flexible, pressurizable, and heatable glue conduits 60 with said glue application nozzles 12, 21, for applying said hot glue in respective relative positions of said glue application nozzles 12, 21 with respect to the box, according to operative parameters associated with the dimensions of the box 50 to be formed, including the dimensions of said upper flaps 54 and lower transverse and/or longitudinal flaps 52, 53 and at least one working temperature of said hot glue previously input in a user interface 101, 107.

Likewise, for all the embodiments, FIGS. 1, 14 to 19, 25, 27, and 31 to 33 show that said machine 200 comprises a control device 100 connected to said user interface 101, 107 configured for controlling at least the temperature of the glue in said reservoir 150, in said conduits 60, and in said injectors 64, including a programmable control device 102 connected to the actuator of said vertical member 7. Said control device 100 is configured for receiving information about: said reservoir heater 151; said heating resistors 153; and said temperature sensors 152. Preferably, said programmable control device 102 is a programmable logic controller, PLC.

Figure 35:
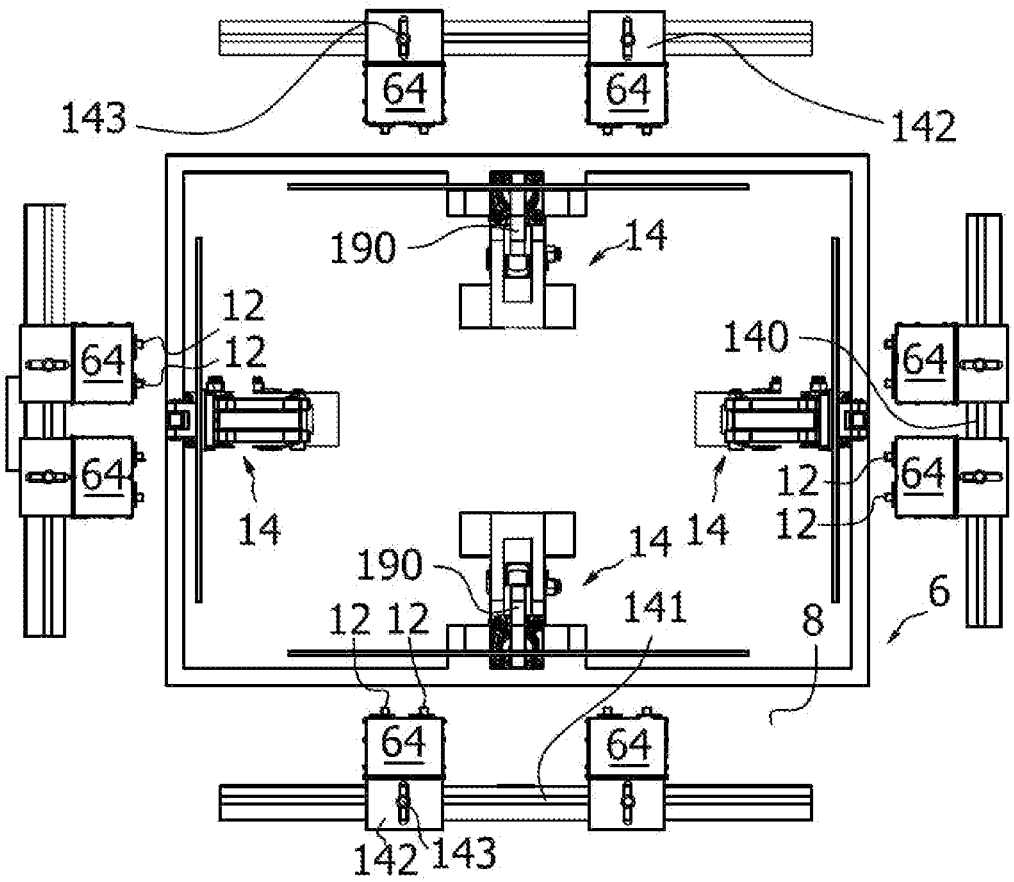
FIG. 35 shows a simplified view of FIG. 12 but according to an alternative embodiment in which the glue application nozzles are facing an outside surface of the box and the upper folding devices are placed inside the box, for folding the upper flaps of the box outwards, adhering said upper flaps against an outer surface of the side walls of the box.

Optionally, in the embodiment shown in FIG. 35, said glue application nozzles 12, 21 are configured for applying said glue on outer surfaces of said upper flaps 54 of the box 50 and said upper folding devices 14 are configured for later folding and pressing said upper flaps 54 against outer surfaces of the side walls 51 of the box 50.

Preferably in all the embodiments, FIGS. 18, 27, and 33 show that in said machine 200, said actuator of said upper vertical member 7 comprises a rotary motor 30 coupled to an encoder 92, said motor and encoder assembly being configured for moving said hold-down plate 8 a desired linear length along said path aligned with said vertical axis Z to a desired active and/or inactive position.

Continuing with FIGS. 15 to 18, 25, 27, and 31 to 33, preferably, in said machine 200 said control device 100 comprises an electronic glue control device 103 additionally configured for sending at least one change in an indicative signal from said temperature sensors 152 to said programmable machine control device 102 of the control device 100 when said temperature sensors 152 have reached said working temperature. Said electronic control device 103 may optionally be embodied in a PLC, or in cards by way of interconnected electronics boards, and in turn connected to a touch or display screen (107).

The machine 200 described up to this point is adapted to implement a method of forming boxes 50 such as the one described in the aforementioned patent application ES2749298A1, in which in the step of applying glue, advantageously in the form of glue beads, on outer or inner surfaces of upper transverse and longitudinal flaps 54 of the box and/or of lower transverse or longitudinal flaps 52, 53 of the box, located above and/or below the operating space 28, respectively, there are now in play very precise position control parameters of the glue application nozzles 12, 21 and glue temperature control parameters, in reference to said glue that is both in the glue supply reservoir 150 and in the flexible, pressurizable, and heatable glue conduits 60, under the control of a control device 100 comprising a programmable control device 102 connected to the actuator of the vertical member 7. With the mentioned elements, an improved method is provided according to this invention in which an electronic glue control device 103 included in said control device 100 sends a signal indicative of any change in the predetermined magnitude detected by the temperature sensors 152 in the glue, and reports any incident in the reservoir heater 151, including the heating resistors 153. It has optionally been envisaged that the control device 100 likewise obtains information about the pressure value of the glue inside the mentioned flexible, pressurizable, and heatable glue conduits 60.

The invention thereby provides an improved method of forming boxes which ensures, by the control of a larger number of variables, the correct positioning of the glue application nozzles 12, 21 and the glue supply conditions at a pre-set temperature at all times and adapted to the particular conditions of the boxes 50 to be formed: thickness of the walls, development of the flaps, inward or outward folding of the upper flaps, etc., according to operating parameters input by an operator in a user interface 101, 107 to which the mentioned control device 100 is connected.

In the first preferred embodiment of said machine 200 of FIGS. 11 to 23, said plurality of glue application nozzles 12, 21 comprises a plurality of lower glue application nozzles 21 and a plurality of upper glue application nozzles 12.

Figure 25:
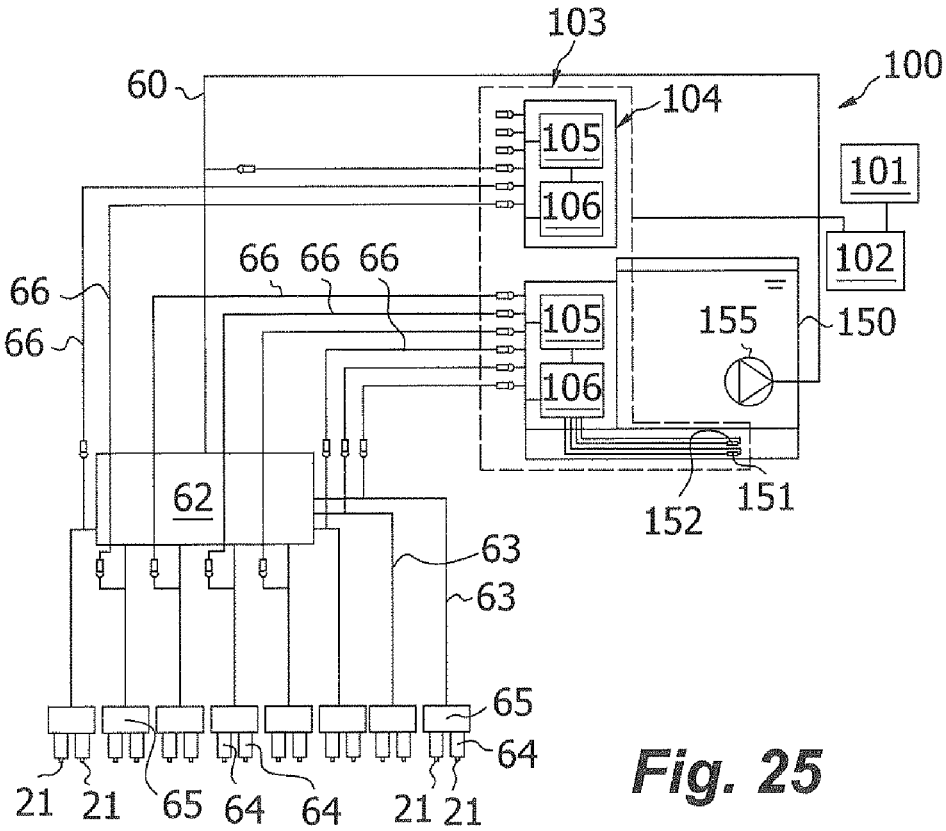
FIG. 25 is a hydraulic connection and wiring diagram of the control device that is an integral part of the second embodiment of the machine.

Said plurality of lower glue application nozzles 21 are supported in said lower glue device 37, and are movable by at least one lower actuator 81 of said lower glue device 37 along said predetermined path aligned with a horizontal linear axis L, and in which said flexible, heatable glue conduits 60 adapt the position of their outlet end towards said plurality of lower glue application nozzles 21 consistent with said at least start position of FIG. 24 and end position of FIG. 25 for the application of glue according to said path aligned with said horizontal linear axis L perpendicular to said vertical axis Z.

Said lower glue device 37 comprises said lower actuator 81 embodied in an auxiliary rotary motor and a power transmission mechanism coupled thereto, such that said plurality of lower glue application nozzles 21 can be moved according to said path aligned with said horizontal linear axis L.

FIGS. 18 to 23 show that said power transmission mechanism of the lower glue device 37 comprises a reduction gear 84 coupled to said auxiliary rotary motor 81, and two pulleys 85 in which there is assembled an endless flexible transmission element 86 coupled to one of said pulleys. In said power transmission mechanism, one of said pulleys 85 is coupled to said reduction gear 84, and in each of the two segments of the endless flexible transmission element 86 demarcated by said pulleys 85 there is assembled a carriage 87 supporting at least one glue application nozzle lower 21, said carriage 87 being configured to slide lengthwise in a linear guide 88, such that in the event of rotation of the auxiliary rotary motor 81 the nozzles of both segments are moved by identical horizontal lengths in opposite directions in a synchronized manner.

FIGS. 18 to 23 show that said machine 200 comprises an auxiliary encoder 83 coupled to said auxiliary rotary motor 81, said motor and encoder 81, 83 assembly being configured to move said plurality of lower glue application nozzles 21 a desired linear length according to said path aligned with said linear axis L, consistent with operative parameters indicative of at least one start and end glue application positions according to said path aligned with said linear axis L.

Alternatively, in an option that is not shown, said plurality of lower glue application nozzles 21 are supported in said lower glue device 37, and are movable by at least one lower actuator 81 of said lower glue device 37 along said predetermined path aligned with a vertical linear axis L.

For forming the box 50 of FIG. 3, it is not necessary to equip the upper forming device 6 with side bearing walls 11 which will be described below, and therefore they are not included in FIGS. 11 to 13.

Figure 13:
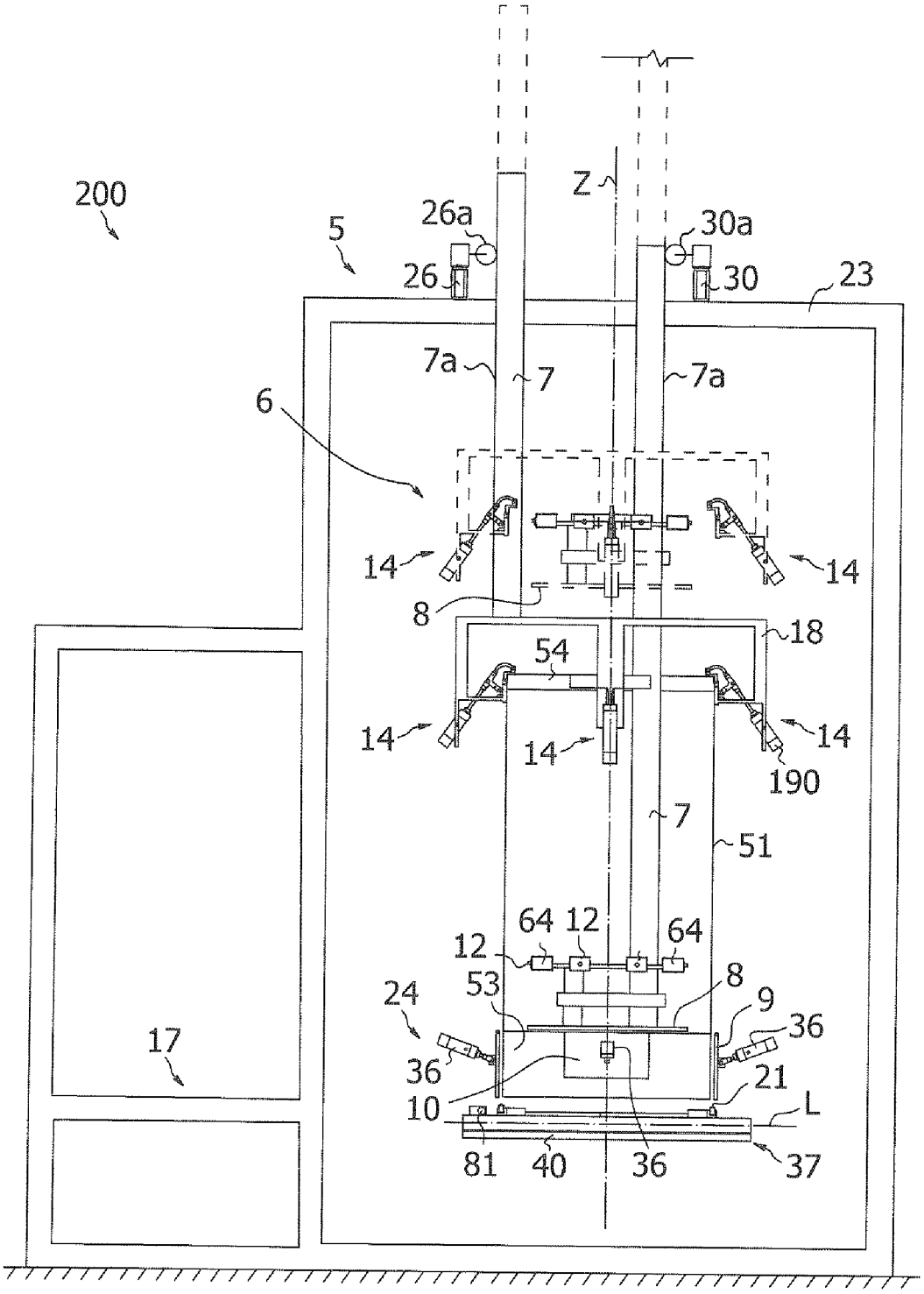
FIG. 13 is a side schematic view corresponding with the machine of FIG. 11, in which the hold-down plate in the inactive position and the upper folding device support in the inoperative position are shown in discontinuous lines, and in which said hold-down plate in its active position and said upper support in an inoperative position are shown in a continuous line.

FIG. 13 shows that said plurality of upper glue application nozzles 12 are supported in said upper vertical member 7 in which said hold-down plate 8 is supported in the upper forming device 6.

Preferably, a rack and pinion-type movement transmission mechanism is configured for moving said hold-down plate 8. The primary pinion **30*a* is coupled to the rotary motor 30, and the primary rack 7*a*, guided vertically by a guide 197 of the upper vertical member 7, engages said pinion 30*a***.

In an alternative embodiment with respect to this first embodiment that is not shown, said plurality of upper glue application nozzles 12 are supported in another upper vertical member 7 of the upper forming device 6 which can be independently operated in relation to said upper vertical member 7.

Figure 14:
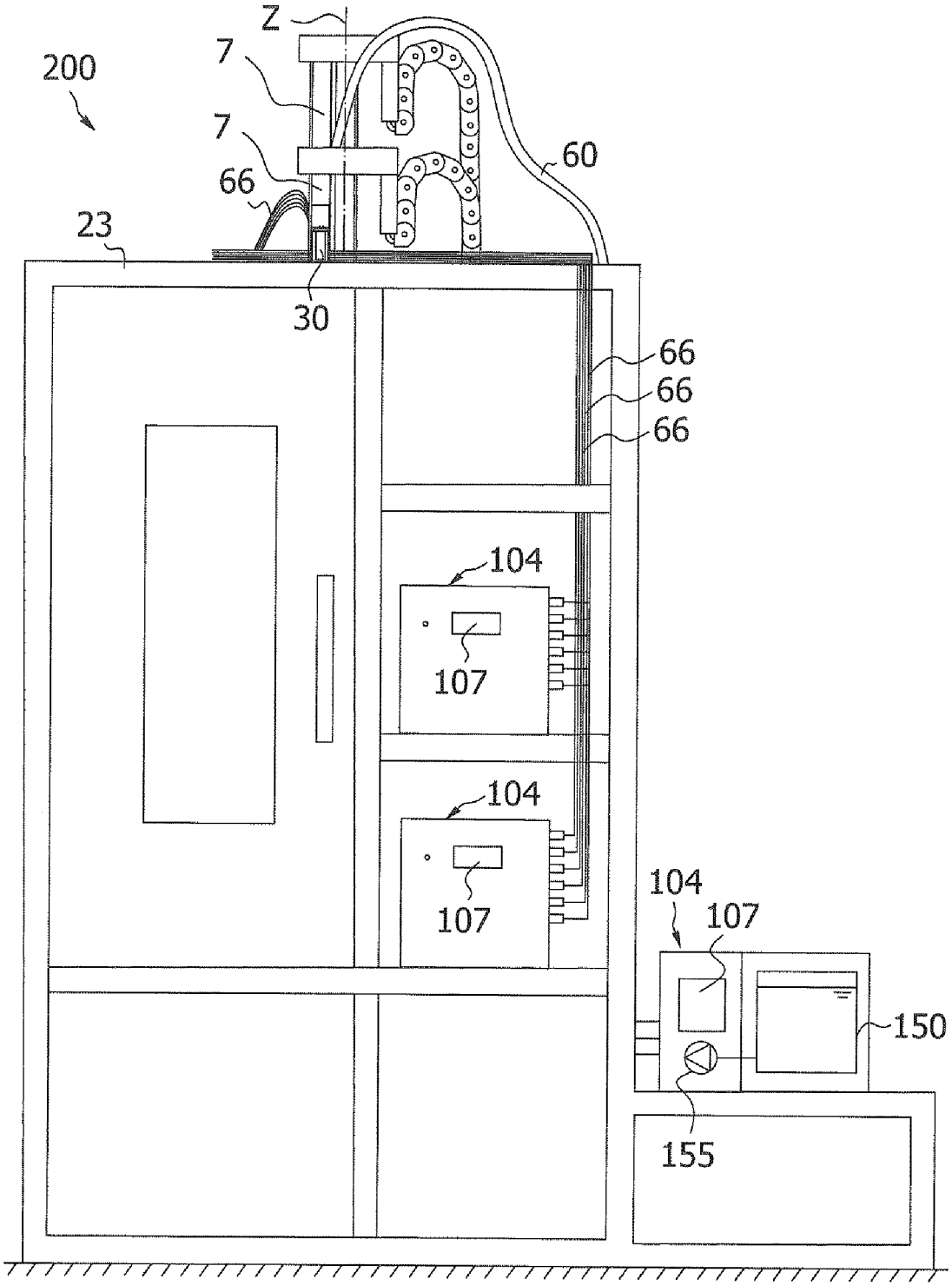
FIG. 14 is a schematic view according to the rear frontal part of the machine.
Figure 15:
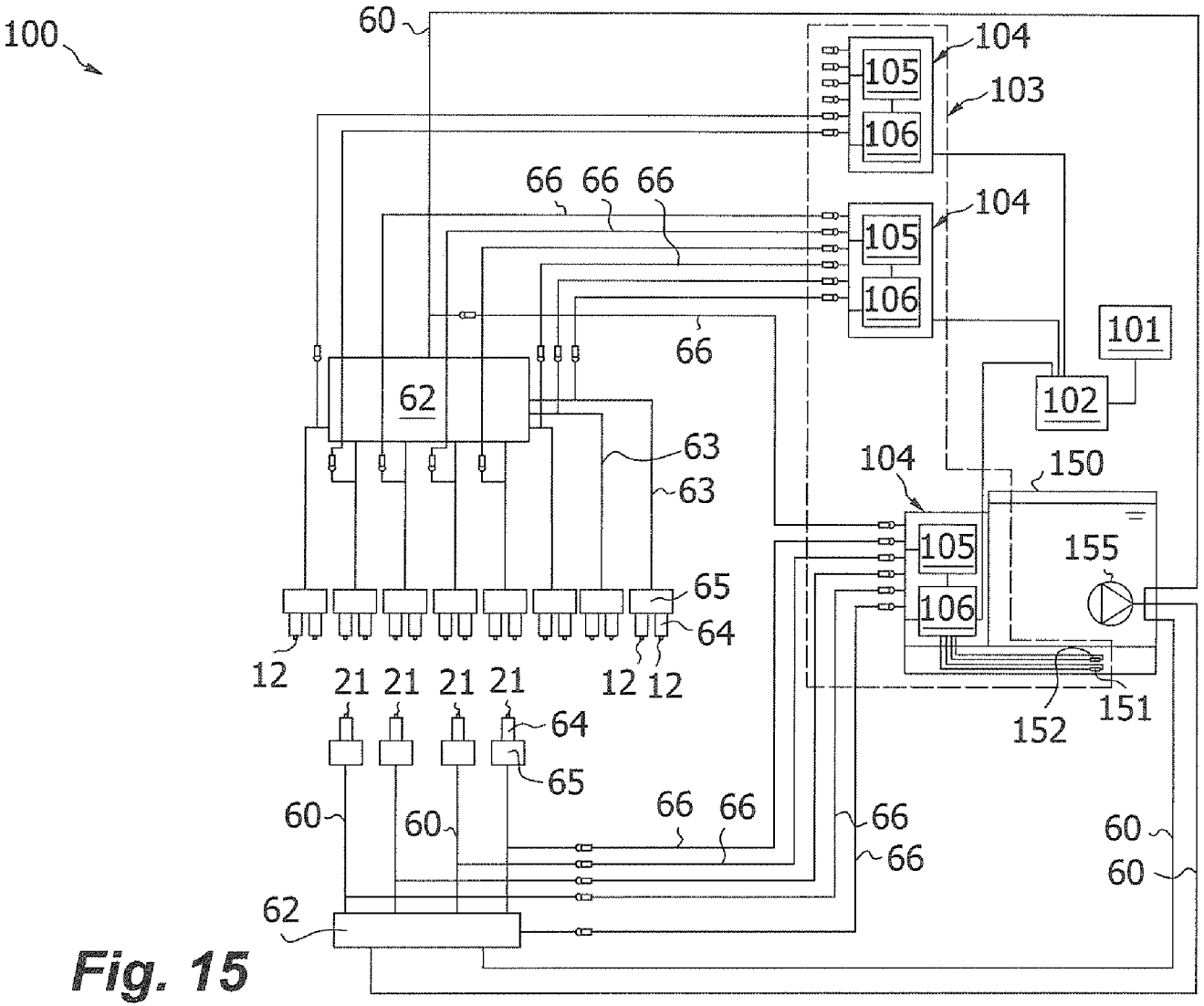
FIG. 15 is a hydraulic connection and wiring diagram of the control device that is an integral part of the first embodiment of the machine.
Figure 16:
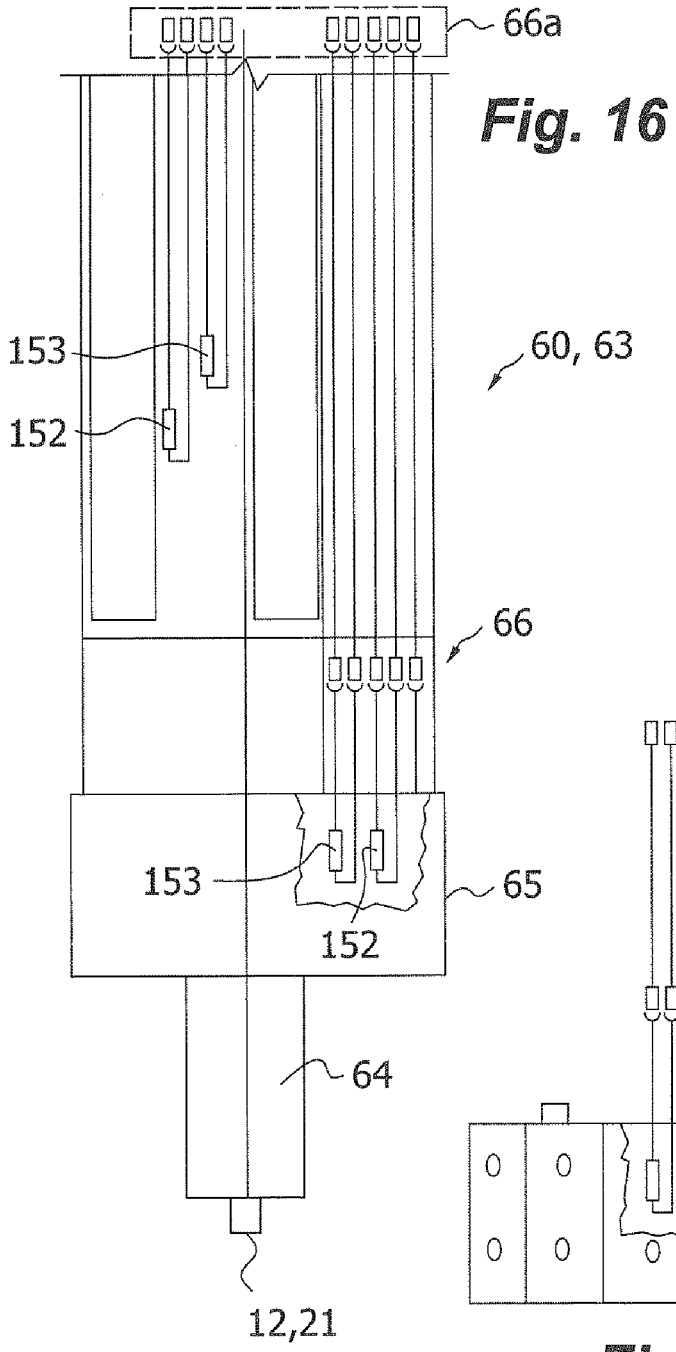
FIG. 16 is a hydraulic connection and wiring diagram of any of the flexible, heatable glue conduits of the present invention.

In this first embodiment of FIGS. 13 to 15, it follows that a subgroup of said flexible, pressurizable, and heatable glue conduits 60 adapt the position of their outlet end towards said plurality of lower glue application nozzles 21 consistent with said start and end glue application positions according to said predetermined path aligned with said horizontal linear axis L, and another subgroup of said flexible, pressurizable, and heatable glue conduits 60 adapt the position of their outlet end towards said plurality of upper glue application nozzles 12 consistent with said start and end glue application positions according to said predetermined path aligned with said vertical axis Z.

Figure 19:
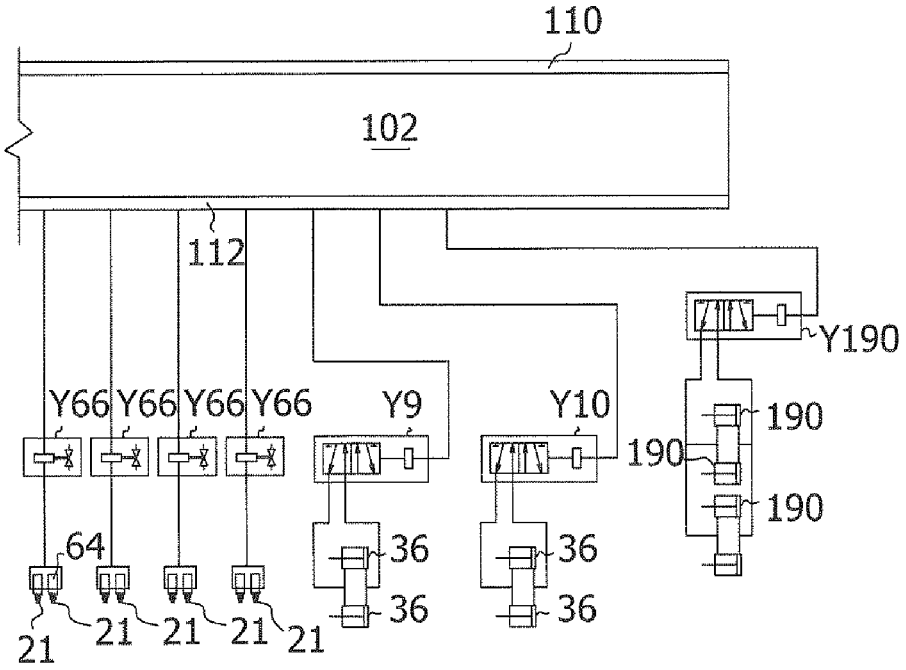

Continuing with said first embodiment, in FIGS. 18 and 19 said machine 200 comprises at least two electrically-operated valves Y66, at least one associated with said plurality of upper glue application nozzles 12 configured for applying glue according to operative parameters associated with the dimensions of said upper flaps 54, and at least another one associated with said plurality of lower glue application nozzles 21 and configured for applying glue according to operative parameters associated with the dimensions of the lower transverse and/or longitudinal flaps 52, 53.

In this example, in FIGS. 15 to 19, for applying glue in the upper flaps 54, the programmable control device 102 has eight electrically-operated valves Y66 connected to its output interface 112, one associated with each pair of glue injectors 64. Each pair of glue injectors 64 is associated with a metal block 65 equipped with a heating resistor 153 and a temperature sensor 152. Each of these glue injectors 64 has an upper glue application nozzle 12, which may have one or more outlet openings.

Likewise, for applying glue in said lower transverse or longitudinal flaps 52, 53, the programmable control device 102 of FIG. 19 has another four electrically-operated valves Y66 connected to its output interface 112, each associated with a glue injector 64 and a metal block 65 equipped with a heating resistor 153 and a temperature sensor 152. Each of these glue injectors 64 has a lower glue application nozzle 21.

Figure 12:
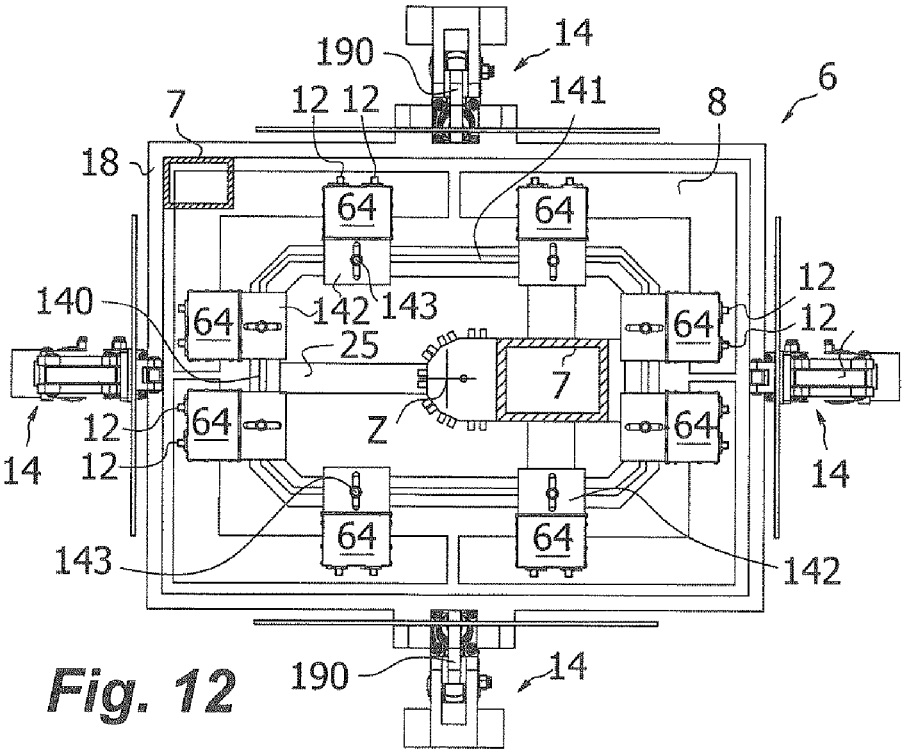
FIG. 12 is a detail view of the machine of FIG. 13, in which its upper forming device is shown.

The upper forming device 6 of the machine 200 of FIGS. 11 and 12 comprises said upper vertical member 7 at the lower end of which there is supported said hold-down plate 8 and a frame 25.

Assembled in the frame 25 there are eight glue injectors 64, each equipped with at least one of said upper glue application nozzles 12. This arrangement allows changing the transverse and/or longitudinal position between glue injectors 64 arranged for applying glue on the same upper flap 54 for the purpose of adapting said machine to changing dimensions of the box 50 using transverse and/or longitudinal positioning device of said injectors. These positioning devices are preferably embodied in respective auxiliary supports 142 attaching each glue injector 64 to the frame 25 and having the capacity to travel in respective transverse and/or longitudinal positioning guides 140, 141 and to be fixed to the frame 25 by respective blocking elements 143, such as screws. With this construction, said machine 200 is configured for applying glue in pairs of respective glue injectors 64 on four upper flaps 54 of the box 50, and it allows changing the relative distance between pairs of glue injectors which apply glue on the same flap of the box 50 so as to be adapted to different sizes or configurations of the box 50.

In an alternative embodiment, the upper forming device 6 has four glue injectors 64 each with a plurality of upper glue application nozzles 12, each glue injector 64 being configured for applying glue on a respective upper flap 54 of the box 50 with a square configuration of FIG. 3.

Continuing with said first embodiment, once the box 50 is unfolded and centered with respect to the vertical axis Z by the action of said positioning device, the upper vertical member 7 at the lower end of which there are supported the hold-down plate 8 and the eight glue injectors 64 is inserted into the box 50 by the action of the rotary motor and encoder 30, 92. Said hold-down plate 8 is moved by said rotary motor 30 and encoder 92 a linear length along said path aligned with said vertical axis Z to a desired active and/or inactive position so as to be adapted to different heights of the box 50 to be formed.

In this particular example, said active position of the hold-down plate 8 is fixed and the inactive position of the hold-down plate 8 is variable, according to the height of the box to be formed, depending on an operative parameter associated with the dimensions of height of the box 50 input by a user in a user interface 101, 107, which in a particular example may be of a touch screen 101 connected to the input interface of the programmable machine control device 102, which can be a PLC.

Prior to the positioning of the hold-down plate 8 in said fixed active position, the lower glue device 37 has applied glue according to a predetermined path L aligned with a horizontal linear axis on the inner surfaces of the longitudinal flaps 53 according to operative glue application start and end parameters associated with the dimensions of said longitudinal flaps 53 input by a user in said user interface 101, 107.

With the hold-down plate 8 in said fixed active position, the control device 100 activates electrically-operated valves Y9, Y10 connected in the output interface of the programmable machine control device 102 moving pneumatic cylinders 36 of said lower flap folding devices 9, 10 facing one another in pairs, for folding lower transverse and longitudinal flaps 52, 53 of the box 50 to which glue was previously applied, from a vertical position to a horizontal position.

In this horizontal position and with the hold-down plate 8 in said fixed active position, the hold-down plate 8 is located adjacent to said lower flap folding devices 9, 10, so as to press said lower transverse and longitudinal flaps 52, 53 to which glue was previously applied against same, thus forming the bottom of the box 50.

For forming the upper flaps 54 of the box 50, said upper forming device 6 comprises an upper folding device support 18 that can be operated to move along said path aligned with the vertical axis Z between an inoperative position outside the operating space 28 and an operative position within the operating space 28, and four upper folding devices 14 for folding upper flaps 54 of the box, facing one another in pairs, installed in the upper folding device support 18 and can be operated for folding the upper flaps 54 of the box 50 to which glue was previously applied, and pressing them against inner surfaces of the side walls 51 of the box 50.

In this first embodiment, said upper folding devices 14 and said upper folding device support 18 can be jointly operated by an additional rotary motor 26 and another vertical upper member 7 cooperating with an additional movement transmission mechanism of the upper forming device 6, preferably of the rack and pinion-type. The additional pinion **26*a* is coupled to the additional rotary motor 26, and the additional rack, guided vertically by a guide 197 of the upper vertical member 7, engages said additional pinion 26*a***.

In said machine 200, said programmable control device 102 has said additional rotary motor 26 connected to its output interface 112.

In said machine 200, said additional rotary motor 26 is coupled to an additional encoder 181, said additional rotary motor and additional encoder 26, 181 assembly being configured to move said upper folding device support 18 and upper folding devices 14 for folding said upper flaps 54 a desired linear length on a path aligned with the vertical axis Z consistent with at least one supplementary operative parameter associated with the dimensions of the upper flaps 54 previously input in said user interface 101, 104, for example in said touch screen 101, by a user. Preferably, said supplementary operative parameter is associated with the vertical position of the folding line separating said upper flaps 54 and/or intermediate flaps 56, 57 and said side walls 51.

Prior to folding these upper flaps 54, said upper vertical member 7 supporting the hold-down plate 8 additionally supports said plurality of upper glue application nozzles 12 arranged for applying glue according to operative parameters indicative of at least one glue application start and end position of said upper glue application nozzles 12, associated with the dimensions of the upper flaps 54, input in said user interface 101, 107 by a user, by a movement of said plurality of upper glue application nozzles 12 according to a path aligned with the vertical axis Z provided by said upper vertical member 7 supporting the hold-down plate 8.

Said plurality of upper glue application nozzles 12 are arranged for applying said glue on inner surfaces of the upper transverse and longitudinal flaps 54 of the box, located above the operating space 28, in the form of continuous or discontinuous glue beads.

Therefore, according to an option of this first embodiment, the upper folding devices 14 for folding upper flaps 54 are placed in a precise and desired vertical position with respect to the upper flaps 54 for folding the upper flaps 54 of the box 50 to which glue was previously applied, and pressing them against inner surfaces of the side walls 51 of the box 50.

Preferably, FIGS. 18 and 19 show that each upper folding device 14 comprises an actuator 190, in the specific example it is a pneumatic cylinder. Said PLC is configured for activating at least one electrically-operated valve Y190 which moves said folding devices 14 for folding the upper flaps 54, when the PLC monitors that the vertical position of the upper flap folding devices corresponds with said supplementary operative parameter, preferably by said additional encoder 181.

Figure 30:
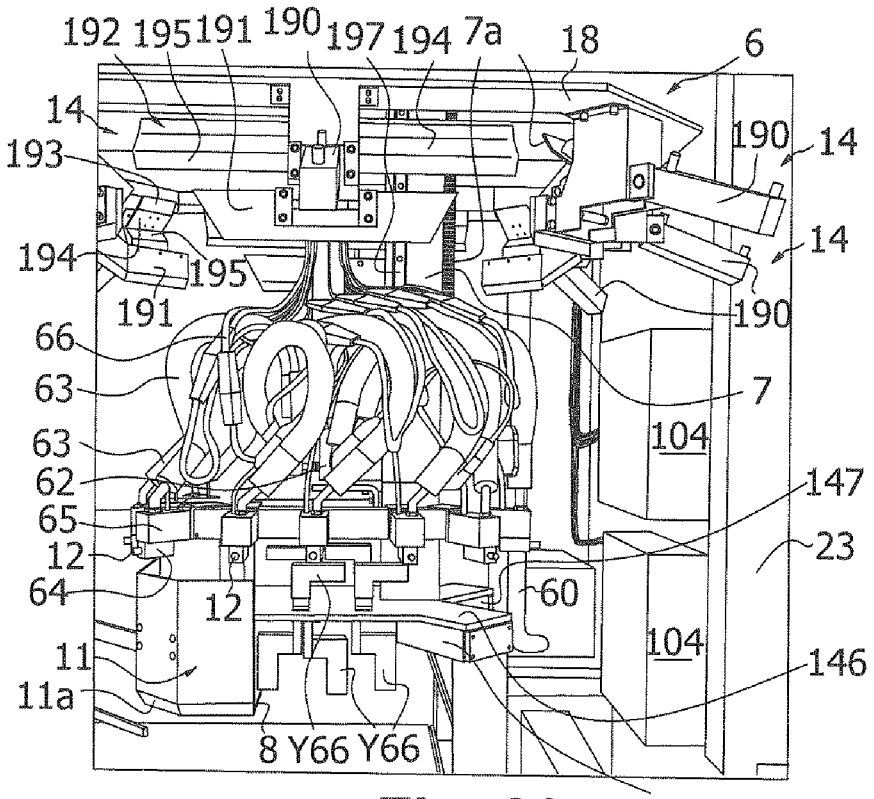
FIG. 30 is a perspective side view corresponding with FIG. 29.

In a preferred manner, each of the upper flap folding devices 14 can be based on the flap folding device described in document ES2536941B1 belonging to the same applicant. Preferably, each of the upper folding devices 14 is configured for being moved between a withdrawn position outside the operating space 28 and a folding and pressure-applying position within the operating space 28. FIG. 30 shows that each of the upper folding devices 14 for folding upper flaps 54 comprises the folding plate 192 comprising a horizontal wall 194 in said folding and pressure-applying position, and a vertical flap 193 in said folding and pressure-applying position, in which position it is configured for pressing on a bearing vertical face 191. It likewise comprises an inclined wall 195 which joins said horizontal wall 194 with said wall vertical 193 such that said three walls are configured for contacting respective upper flaps 54 and triangular reinforcement intermediate flaps 56, 57 folded against the inside of the side walls 51 of the box 50 of FIGS. 4 and 10. Alternatively, the upper flap folding devices 14 can be configured for folding and attaching the reinforcement of the opening of the box 50 against the outside of the side walls 51 of the box 50.

FIGS. 15, 18, and 19 show, according to an option of this first embodiment, a control device 100 comprising a programmable machine control device 102 and an electronic glue control device 103. The control device 100 has a user interface 101, which can be a touch screen, connected to an input interface 110 of said programmable machine control device 102, for example a PLC. Likewise, the PLC has the electronic glue control device 103 connected to its input interface 110 for sending at least one change in an indicative signal from said temperature sensors 152 to said programmable machine control device 102 of the control device 100 when said temperature sensors 152 have reached said working temperature.

Said electronic control device 103 optionally comprises a plurality of control units 104 connected to a single reservoir 150 and pressure element 155 such as a pump, each control unit 104 comprising a power card 105 connected to the heating resistors 153 of flexible, pressurizable, and heatable glue conduits 60 and glue injectors 64, and a control card 106 for controlling the temperature of said temperature sensors 152 of said flexible, heatable glue conduits 60 and metal blocks 65 associated with the glue injectors 64. Said temperature sensors 152 and/or pressure sensor (not shown) can be connected to these control cards 106.

Said control units 104 are connected to the input interface 110 of the PLC by a single cable which connects in series the plurality of said control cards 105, FIG. 18, or by separate cables, not shown.

In FIGS. 18 and 19 it can be observed that said PLC of the machine has connected thereto said rotary motor 30 coupled to said encoder 92. Optionally, the programmable machine control device 102 furthermore has connected thereto: said auxiliary rotary motor 81 coupled to said auxiliary encoder 83, said secondary rotary motor 29 coupled to said secondary encoder 29, said additional rotary motor 26 coupled to said additional encoder 181, and said complementary motor 169 coupled to said complementary encoder 171.

Preferably, the respective rotary motor and encoder assemblies are integrated in respective servomotors, each of which is connected to a respective servomotor controller 90, 82, 43, 180, 170 connected to the programmable machine control device 102.

FIGS. 14 to 19, 25 and 27, and 30 to 33 show for all the first, second, and third embodiments, a machine 200 in which preferably at least one of said flexible, pressurizable, and heatable glue conduits 60 is hydraulically connected at its proximal end to said reservoir 150, and is hydraulically connected at its distal end to at least the upper glue distributor 62.

Likewise in this preferred option, said machine 200 comprises a whole number of upper hot glue distributors 62 comprised between one and four, supported in said upper vertical member 7, said another vertical member 7, in said upper forming device 6, or in said support structure 23.

In the specific case of FIG. 30, the glue distributor 62 is supported in said upper vertical member 7 where the hold-down plate 8 is supported.

Also preferably, FIGS. 15, 25, 30, and 32 show that said machine 200 comprises at least four auxiliary flexible, pressurizable, and heatable glue conduits 63 which hydraulically connect upper hot glue distributors 62 with respective hot glue injectors 64 of said plurality of upper glue application nozzles 12 and/or lower glue application nozzles 21. Said auxiliary flexible, pressurizable, and heatable glue conduits 63 are supported next to said glue injectors 64 in said upper vertical member 7, said another vertical member 7, in said upper forming device 6, or in said support structure 23.

Figure 32:
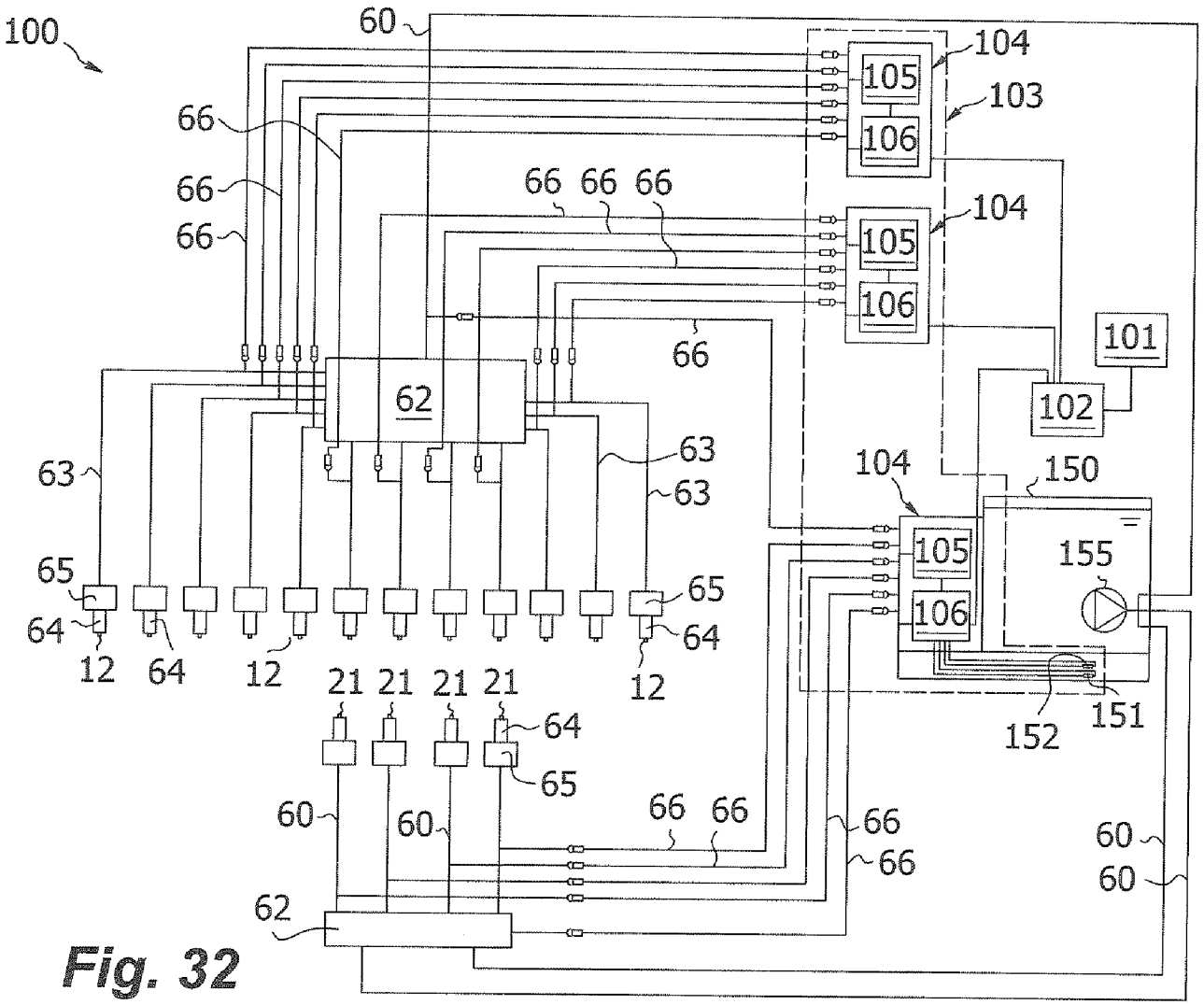
FIG. 32 is a hydraulic connection and wiring diagram of the control device that is an integral part of the third embodiment of said machine.

In the specific case of FIGS. 30 and 32, the glue distributor 62 is supported in said upper vertical member 7 where the hold-down plate 8 is supported.

Figure 29:
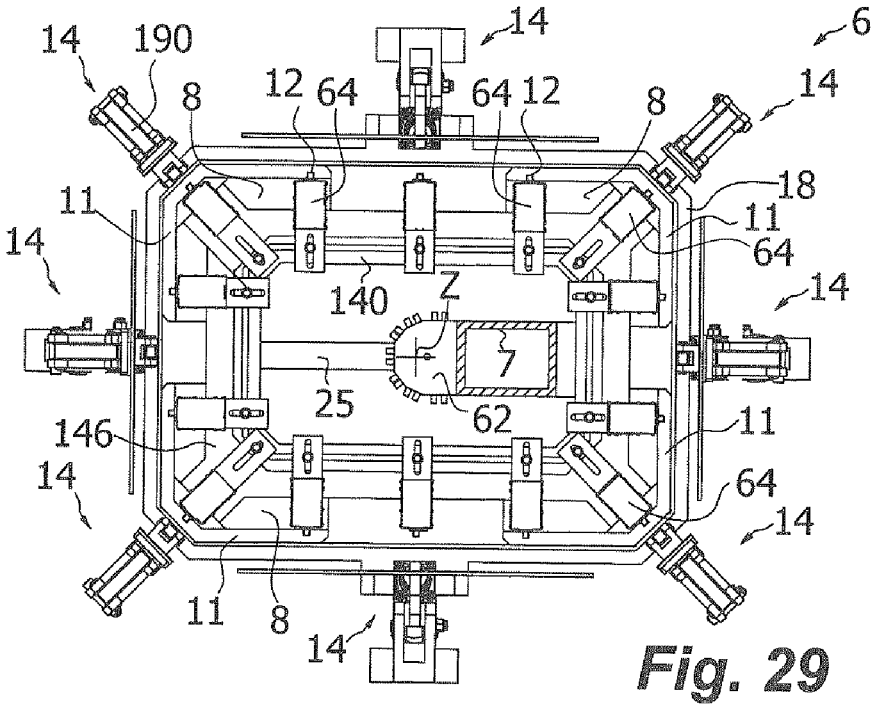
FIG. 29 is a detail view of the upper forming device of the machine shown in FIG. 28, according to a third preferred embodiment of said machine, suitable for forming any of the octagonal boxes of FIGS. 6 and 9.

In FIGS. 28 to 30, it can be observed that said flexible, heatable glue conduits 60 occupy a central area centered with respect to a path aligned with said vertical axis Z, and the auxiliary flexible, heatable conduits 63 extend from said central area towards said plurality of glue application nozzles 12, 21 located around said central area, demarcating it.

In said first, second and third embodiments, FIGS. 15, 25, 30 and 32 show that optionally said machine further comprises a plurality of extension cords 66, each with a proximal end connected to said control device 100 and a distal end connected to a respective auxiliary flexible, heatable conduit 63, configured for feeding said resistors and sensors 152, 153 of said auxiliary flexible, heatable conduits 63 and the resistors and sensors 152, 153 associated with the glue injectors 64 connected to said auxiliary heatable conduits 63. Also, in said machine 200, respective segments adjacent to said distal end of said plurality of extension cords 66 are essentially vertical according to a path aligned with said vertical axis Z and are located around or in said central area, as observed in detail in FIG. 30.

Figure 17:
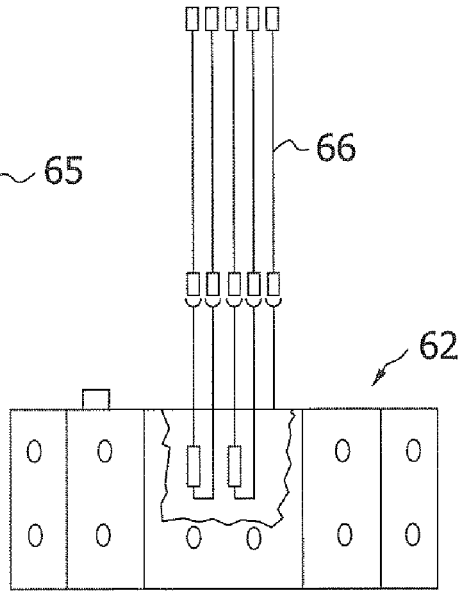
FIG. 17 is a schematic view of a glue distributor of the machine of the present invention according to a preferred embodiment.

In FIG. 17, it can be observed that an upper hot glue distributor 62 is configured with at least one inlet opening, between eight and eighteen glue outlet openings, and equipped therein with a heating resistor 153 and a temperature sensor 152. In the example of the first embodiment, eight outlet openings are connected with respective eight glue injectors 64, optionally, through respective associated metal blocks 65.

FIGS. 24 to 27 show a second preferred embodiment of said machine 200 for forming the boxes of FIG. 3, in which said plurality of glue application nozzles 12, 21 comprises a plurality of lower glue application nozzles 21 and do not necessarily comprise a plurality of upper glue application nozzles 12, nor do they necessarily comprise said lower glue device 37.

Said plurality of lower glue application nozzles 21 are supported in said upper vertical member 7 of the upper forming device 6 in which the hold-down plate 8 is supported. Said lower glue application nozzles 21 are configured for applying glue between said start and end positions, without horizontal movement of the box within the operating space 28, along said predetermined path which is a linear axis L aligned with said vertical axis Z.

In an alternative embodiment that is not shown, said plurality of lower glue application nozzles 21 are supported in another upper vertical member 7 of the upper forming device 6 located in the forming station 5 above the operating space 28 and arranged relative to a vertical axis Z, which can be independently operated by another rotary motor in cooperation with a movement transmission mechanism so as to be moved on a path aligned with said vertical axis Z, said predetermined path is aligned with a linear axis L parallel to said vertical axis Z.

Continuing with said second preferred embodiment, in said machine 200, said flexible, pressurizable, and heatable glue conduits 60 adapt the position of their outlet end towards said plurality of glue application nozzles 12, 21 consistent with said at least start and end glue application positions according to said predetermined path aligned with said vertical linear axis L.

In FIGS. 25 and 27 of this second embodiment, said lower glue application nozzles 21 are associated with at least one electrically-operated valve Y66 and configured for applying glue on said upper flaps 54 and said lower transverse or longitudinal flaps 52, 53, according to operative parameters associated with the dimensions of said upper flaps 54 and said lower transverse or longitudinal flaps 52, 53 previously input in a user interface 101, 107. That is, although FIG. 27 shows eight electrically-operated valves, one for each glue injector 64, one electrically-operated valve would be enough for all the glue injectors 64. Whatever the case may be, the programmable machine control device 102 is configured so that preferably the same electrically-operated valve or valves Y66 open and close at least two times, at least one time for applying glue on said upper flaps 54 and at least another time for applying glue on said lower transverse or longitudinal flaps 52, 53.

In a preferred variant of this second embodiment that is not shown, said machine 200 comprises at least two electrically-operated valves Y66, at least one associated with a subgroup of said plurality of lower glue application nozzles 21 configured for applying glue according to operative parameters associated with the dimensions of said upper flaps 54, and at least another subgroup of said plurality of lower glue application nozzles 21 configured for applying glue according to operative parameters associated with the dimensions of the lower transverse and/or longitudinal flaps 52, 53.

Again, it is not necessary to equip the upper forming device 6 of FIG. 26 with side bearing walls 11, which will be described below for another embodiment.

Figure 26:
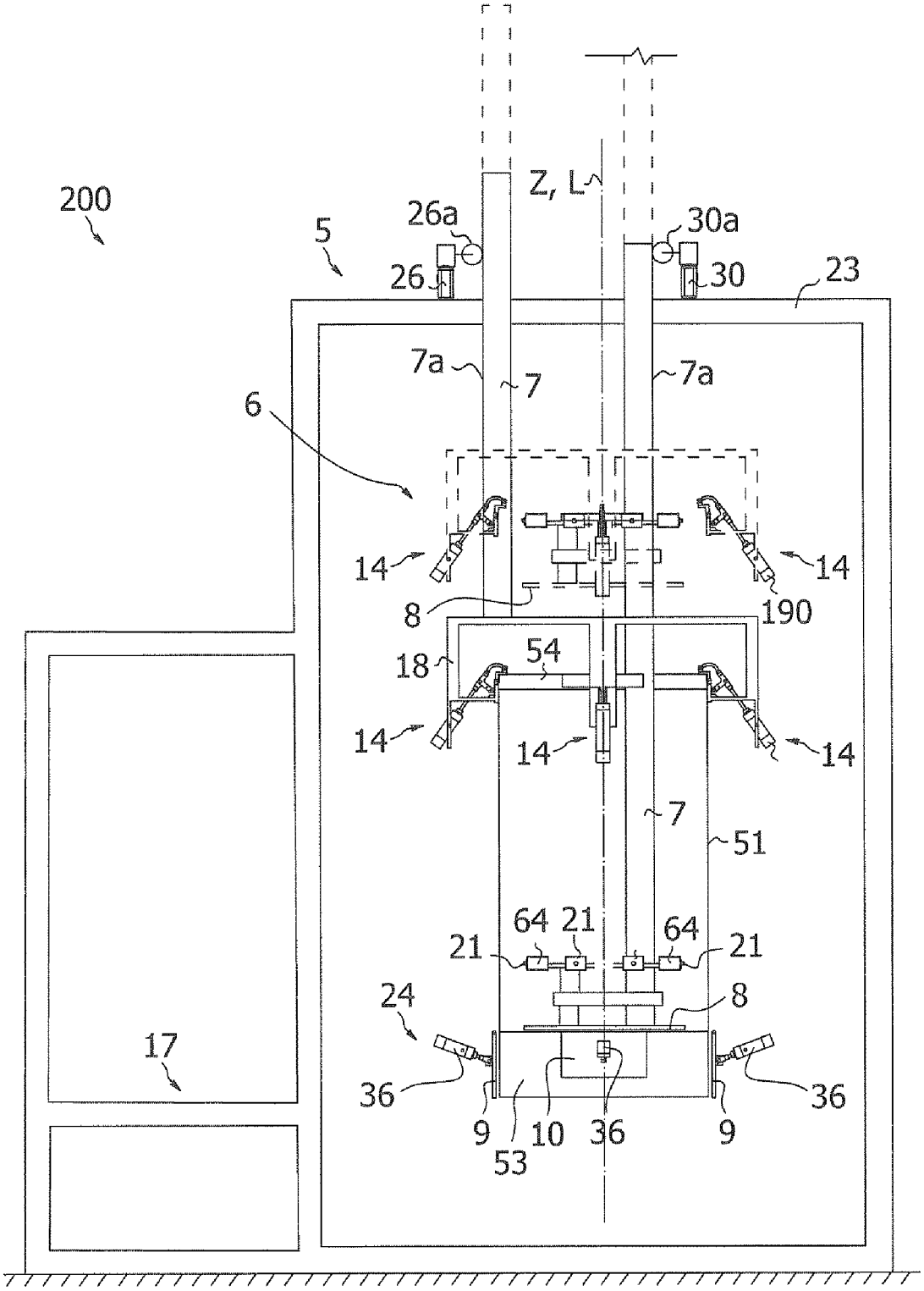
FIG. 26 is a side schematic view corresponding with the machine of FIG. 24, in which the hold-down plate in the inactive position and the upper folding device support in the inoperative position are shown in discontinuous lines, and in which said hold-down plate in its active position and said support upper in the inoperative position are shown in a continuous line.

In this second embodiment of FIGS. 25 and 26, it follows that said flexible, pressurizable, and heatable glue conduits 60 adapt the position of their outlet end towards said plurality of lower glue application nozzles 21 consistent with said start and end glue application positions according to said predetermined path aligned with said linear axis L parallel to said vertical axis Z.

The upper forming device 6 of this second embodiment may correspond with the one shown in FIGS. 11 and 12 and described above, although it functionally differs in some aspects described below.

Once the box is unfolded and centered with respect to the vertical axis Z by the action of said positioning device, the upper vertical member 7, at the lower end of which there are supported the hold-down plate 8 and the eight glue injectors 64, is inserted into the box 50. Said hold-down plate 8 is moved by said rotary motor 30 and encoder 92 a linear length along said path aligned with said vertical axis Z to a desired active and/or inactive position so as to be adapted to different heights of the box 50 to be formed.

In this specific example, said inactive position of the hold-down plate 8 is fixed and said active position of the hold-down plate 8 is variable, according to the height of the box to be formed, depending on an operative parameter associated with the height dimensions of the box 50 input by a user in a user interface 101, 107, which in a particular example may be a touch screen 101 connected to the input interface of the programmable machine control device 102, which can be a programmable logic controller PLC.

Prior to positioning the hold-down plate 8 in said desired variable active position, the plurality of lower glue application nozzles 21 supported in said upper vertical member 7 have applied glue according to a predetermined path L aligned with a vertical linear axis L parallel to the vertical axis Z on the inner surfaces of the transverse or longitudinal flaps 52, 53, according to operative glue application start and end parameters associated with dimensions of said transverse or longitudinal flaps 52, 53 input by a user in said user interface 101, 107.

With the hold-down plate 8 in said desired active position, the control device 100 activates electrically-operated valves Y9, Y10 connected in the output interface of the programmable machine control device 102 moving pneumatic cylinders 36 of said lower flap folding devices 9, 10 facing one another in pairs, for folding lower transverse and longitudinal flaps 52, 53 of the box 50 to which glue was previously applied, from a vertical position to a horizontal position.

In this horizontal position and with the hold-down plate 8 in said desired active position, the hold-down plate 8 is located adjacent to said lower flap folding devices 9, 10, so as to press said lower transverse and longitudinal flaps 52, 53 to which glue was previously applied against same, thus forming the bottom of the box 50.

For forming the upper flaps 54 of the box 50, the lower glue application nozzles 21 apply glue on the inner surfaces of the upper flaps 54 of the box 50 by the mentioned at least one electrically-operated valve Y66, consistent with operative parameters associated with the dimensions of said upper flaps 54.

In this example, the upper forming device 6 comprises eight glue injectors 64 each equipped with at least one of said glue application nozzles 12, 21, each configured for applying glue on a respective upper flap 54 of the box 50.

Once the upper flaps 54 have been precisely glued by the movement of the motor and encoder 30, 92 assembly, in the example of FIG. 27 said upper forming device 6 folds and presses said upper flaps 54 against outer surfaces of the side walls 51 of the box 50.

According to FIG. 27, in a variant of this second embodiment, said upper forming device 6 of FIG. 26 may further include four other additional upper flap folding devices 14, each intercalated between said four upper folding devices 14 facing one another in pairs, amounting to a total of at least eight. Said upper flap folding devices 14 are arranged around the outer or inner part of said eight glue injectors 64 with respect to a path aligned with the vertical axis Z.

In FIG. 27, each upper flap folding device 14 is associated with a respective actuator 190 which can be embodied in pneumatic cylinders.

For forming the upper flaps 54 of the box 50, said upper forming device 6 comprises an upper folding device support 18 that can be operated to move along said path aligned with the vertical axis Z between an inoperative position outside the operating space 28 and an operative position within the operating space 28, and said four or eight folding devices 14 for folding upper flaps 54 of the box, installed in the upper folding device support 18 and can be operated for folding the upper flaps 54 of the box 50 to which glue was previously applied, and pressing them against inner surfaces of the side walls 51 of the box 50.

In this second embodiment, said upper flap folding devices 14 and said upper folding device support 18 can be operated in a manner similar to the first embodiment.

A third preferred embodiment shown in FIGS. 28 to 33 has features similar to the first embodiment as well as the features described below.

FIGS. 29 and 30 show that said upper forming device 6 comprises four side bearing walls 11, two with front faces parallel to one another and two with side faces parallel to one another perpendicular to the front faces, arranged around a path aligned with said vertical axis Z, and movable according to a path aligned with said vertical axis Z, between a position within the operating space 28 shown in FIG. 30 and a position outside the operating space 28. Said side bearing walls 11 are associated with at least one actuator 147 configured for moving them according to a transverse and/or longitudinal direction pushing from the inside of the box 50 between a contracted position in which said side bearing walls 11 can be inserted into the box 50 with an essentially rhomboidal or rectangular configuration, and an expanded position in which the box 50 has a four-, eight-, or twelve-sided configuration. Preferably, said at least one actuator 147 is supported in a secondary support 146 integrated in said frame 25 in a lower level according to said vertical axis Z with respect to the glue injectors 64.

In this third embodiment, said side bearing walls 11 are supported in said upper vertical member 7 and are therefore movable by said rotary motor and encoder 30, 92 assembly.

Namely in the case of the figures, each of the four side bearing walls 11 has an associated actuator 147. Furthermore, said side bearing walls 11 are supported in the upper vertical member 7 through a frame 25. In the expanded position, the box 50 has an eight-sided configuration. In the illustrated example, the side bearing walls 11 have eight faces configured according to the inner shape of the box 50 with an octagonal configuration.

FIG. 30 shows that said hold-down plate 8 can be a horizontal extension starting from the side walls 11 supported in said arm 7.

For the purpose of improving the insertion in changing box sizes, said support arm or said eight support arms 7 have fixed thereto at least four inclined faces 11*a* facing one another in pairs, converging downwardly towards the vertical axis Z. In example of FIG. 30, only one of said side walls 11 is shown, and said inclined faces 11*a* start from said side walls 11.

In this third embodiment, said upper forming device 6 comprises eight glue injectors 64 each equipped with at least one of said glue application nozzles 12, 21, said glue injectors 64 each being configured for applying glue on a respective upper flap 54 of a box 50, equipping the box 50 with a reinforcement with an octagonal configuration. Also, said upper forming device 6 comprises four other additional upper flap folding devices 14, each intercalated between said four upper folding devices 14 facing one another in pairs, said eight upper flap folding devices 14 being arranged around the outer or inner part of said eight glue injectors 64 with respect to a path aligned with the vertical axis Z. The forming device 6 thus comprises eight upper flap folding devices 14, one oriented towards each of the eight upper flaps 54 of the box 50.

Preferably, FIGS. 28 to 33 show that said upper forming device 6 comprises twelve glue injectors 64, each equipped with at least one of said upper glue application nozzles 12. Eight of these twelve glue injectors 64 are configured for applying glue in pairs on respective alternating sides of upper flaps 54 of a box 50 with an upper octagonal reinforcement. Four glue injectors 64 are each equipped with at least one of said upper glue application nozzles 12 for applying glue on one of the respective remaining alternating flaps of said octagonal box. Said upper forming device 6 thus adapts the location of the injectors to the changing size of the box 50.

Once the box is unfolded and centered with respect to the vertical axis Z by the action of said positioning device, the upper vertical member 7, at the lower end of which there are supported the hold-down plate 8 and the eight glue injectors 64, is inserted into the box 50. Said hold-down plate 8 is moved by said rotary motor 30 and encoder 92 a linear length along said path aligned with said vertical axis Z to a desired active and/or inactive position so as to be adapted to different heights of the box 50 to be formed.

Like in the other cases, the hold-down plate 8 reaches its active position by travelling a variable length, according to the height of the box to be formed, depending on an operative parameter associated with the dimensions of height of the box 50 input by a user in a user interface 101, 107, which in a particular example may be a touch screen 101 connected to the input interface of the programmable machine control device 102, which can be a programmable logic controller PLC.

Prior to application of glue on the lower flaps in this example by the lower glue device 37, the box 50 is expanded from the inside by the side bearing walls 11 until it adopts an octagonal configuration.

With the box 50 in the expanded position, its side walls 51 and upper flaps 54 are located in a precise position and centered with respect to the vertical axis Z with an octagonal configuration.

Next, the lower glue device 37 applies glue on the lower longitudinal or transverse flaps 52, 53 with the box in the expanded position so as to keep the octagonal shape of the box 50 consistent with operative glue application start and end parameters according to a linear direction L associated with the dimensions of the lower longitudinal and/or transverse flaps 52, 53.

After said application of glue, the lower transverse and longitudinal flaps 52, 53 are formed with said lower forming device 24 and said hold-down plate 8 as described. The operation of the lower forming device 24 and said hold-down plate 8 is similar to that described for the first embodiment.

Once the box has adopted the octagonal configuration, the upper flaps are located in a precise position and centered with respect to the vertical axis Z with an octagonal configuration of the side walls 51 and upper flaps 54.

From this point, the box 50 with the bottom formed in an octagonal configuration is positioned in that centered position by the gripping body 2 of the positioning device or of the unfolding and translation device 27.

With the box 50 held at least by the gripping body 2, the glue injectors 64 supported in said upper vertical member 7 apply glue on the at least eight upper flaps 54 of the box 50.

Figure 31:
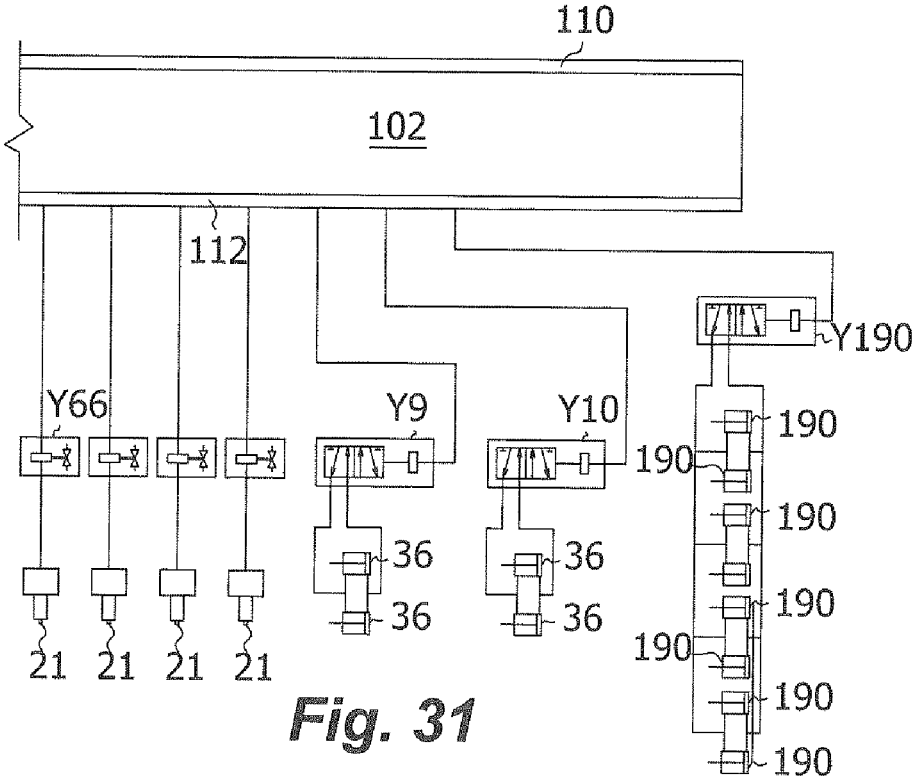
FIGS. 31 and 33 are respective parts of a wiring diagram of the control device of the machine showing the connections to the different elements integrated in the machine of the present invention according to said first embodiment.

The elements integrated in the upper forming device 6 and its operation and control, as well as said control device 100, are all similar to that described for the first embodiment, being adapted for said four flap folding devices 14 and at least four additional glue injectors 64, as shown in FIGS. 31 to 33.

Alternatively, this third embodiment can be adapted for forming boxes 50 with twelve side walls 51 with a dodecagonal configuration.

Figure 34:
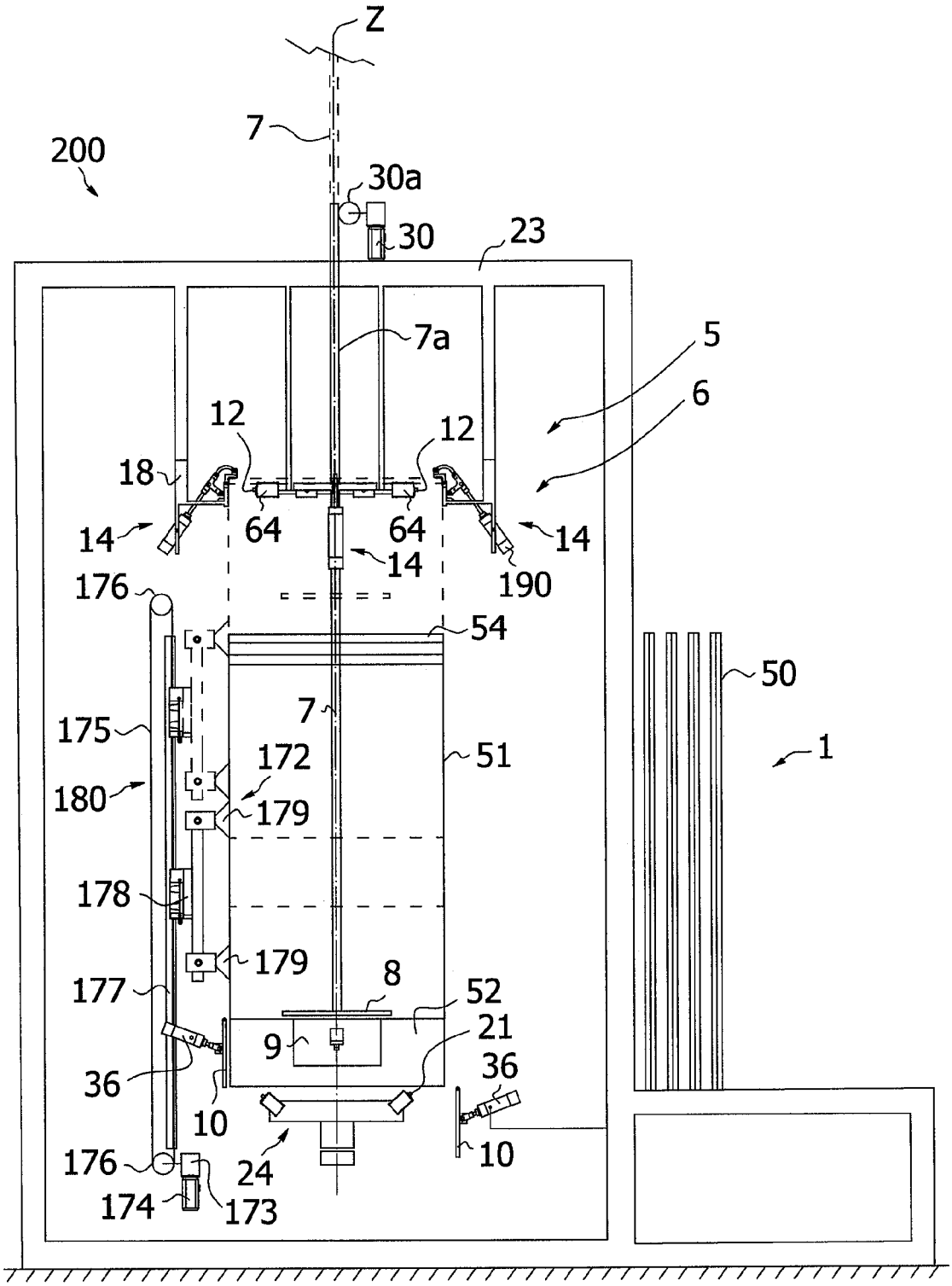
FIG. 34 is a side schematic view of said machine, according to a fourth preferred embodiment, in which the hold-down plate in the inactive position is shown in discontinuous lines and the auxiliary gripping body of the auxiliary device is shown in a desired vertical position.

According to the fourth preferred embodiment of FIG. 34, in said machine 200, said upper folding devices 14 are preferably fixed indirectly in the support structure 23 by said upper folding device support 18. Said machine 200 comprises a plurality of upper glue application nozzles 12 and a plurality of lower glue application nozzles 21.

In one embodiment, said plurality of lower glue application nozzles 21 are supported in said lower glue device 37, and arranged for applying glue on said outer or inner surfaces of said lower transverse flaps 52 and/or lower longitudinal flaps 53.

Alternatively, in an option that is not shown, said plurality of lower glue application nozzles 21 are supported in said support structure 23 and arranged for applying glue on said outer or inner surfaces of said lower transverse flaps 52 and/or lower longitudinal flaps 53 by a movement of a box 50 according to a path aligned with said vertical axis Z provided by said auxiliary device 180.

Continuing with the fourth embodiment of FIG. 34, said plurality of upper glue application nozzles 12 are fixed directly in the support structure 23. Alternatively, in an option that is not shown, they can be fixed through an auxiliary support.

Continuing with the fourth embodiment of FIG. 34, said plurality of upper glue application nozzles 12 are arranged for applying glue on said inner surfaces of said upper flaps 54 by a movement of a box 50 according to a path aligned with said vertical axis Z provided by said auxiliary device 180 of the forming station 5 and located adjacent to one side of the operating space 28.

Alternatively, in an embodiment that is not shown, said plurality of upper glue application nozzles 12 are arranged for applying glue on said outer surfaces of said upper flaps 54 by a movement of a box 50 according to a path aligned with said vertical axis Z provided by said auxiliary device 180.

Said machine 200 of FIG. 34 comprises at least two electrically-operated valves Y66, at least one associated with said plurality of upper glue application nozzles 12, configured for applying glue according to operative parameters associated with the dimensions of said upper flaps 54, and at least another one associated with said plurality of lower glue application nozzles 21 of the lower glue device 37, configured for applying glue according to operative parameters associated with the dimensions of the lower transverse and/or longitudinal flaps 52, 53. In this example, said machine 200 has eight glue injectors 64 of said plurality of upper glue application nozzles 12, facing one another in pairs.

Said auxiliary device 180 comprises an auxiliary gripping body 172 provided with auxiliary suction cups 179 supported in an auxiliary carriage 178 coupled along a vertical guide 177, said auxiliary carriage 178 being attached to an auxiliary endless secondary flexible transmission element 175 assembled on two secondary pulleys 176, one of which is coupled to an auxiliary secondary reduction gear 173 coupled to an auxiliary secondary rotary motor 174 coupled to a auxiliary secondary encoder, said auxiliary secondary rotary motor and encoder assembly being configured to move said auxiliary gripping body 172 vertically to at least one desired vertical upper position aligned with said vertical axis Z for forming said upper flaps 54, consistent with an operative parameter associated with dimensions of the flaps 54 to be formed input in a user interface 101, 107 by a user.

Optionally, said auxiliary secondary rotary motor and encoder assembly moves said auxiliary gripping body 172 vertically to at least one desired lower position aligned with said vertical axis Z for applying glue on the inner or outer surfaces of the lower longitudinal or transverse flaps 52, 53, consistent with an operative parameter associated with the dimensions of the lower longitudinal or transverse flaps 52, 53 to be formed input in a user interface 101, 107 by a user.

Depending on the position of said lower longitudinal and/or transverse flaps 52, 53, the lower glue application nozzles 21 apply glue on said flaps, and then the upper forming device 24 folds them consecutively against the hold-down plate 8 when said plate 8 has been positioned within the operating space 28 in a desired active position by said rotary motor 30 and encoder 92 assembly, adjacent to said lower flap folding devices 9, 10, so as to press said lower transverse and longitudinal flaps 52, 53 to which glue was previously applied against same.

When the auxiliary device 180 moves the box 50 vertically towards said desired vertical position, the upper glue application nozzles 12 fixed in the support structure 23 apply glue on the inner surface the upper flaps 54 of the box 50, consistent with the position of the auxiliary gripping body 172 and box 50 indicated by said auxiliary secondary encoder coupled to the auxiliary secondary motor 175.

Once the upper flaps 54 have been glued, they are located in said desired vertical position such that the upper flap folding devices 14 fold said upper flaps 54 towards the inside of the side walls 51 of the box 50.

In FIG. 34, there are at least four flap folding devices 14 facing one another in pairs, each preferably associated with an actuator 190, which can be of the pneumatic cylinder-type.

Once the box has been formed, said ejection device 160 preferably discharges the box to the aforementioned belt 17.

Throughout this description, "rotary motor" comprises a rotary motor of a servomotor that integrates an encoder, connected to a servomotor controller, an electric rotary motor connected to a variable frequency drive connected to said rotary motor in turn coupled to an encoder, or an electric motor in general.

"Encoder" shall be understood in this specification to mean any detection device, particularly associated with the shaft of a rotary motor, providing a response indicative of the rotational movement imparted by said motor, by an electric signal that can be read by any type of control device in a movement control system, such as a PLC.

Throughout this description, "user interface" may comprise a touch screen, a display screen, push buttons, selectors, and/or any of the "controls" defined in Directive 2006/42/EC on machinery, among others.

In the present invention, the term "programmable control device" comprises any controller in which the program stored therein is computer-readable and/or programmable. Examples thereof are the terms "microcontroller", "controller", "programmable automaton", "control system", "control unit", "programmable logic controller", "processor", "microprocessor", "computing machine", and "computer", among others.

The term "connected" comprises directly or indirectly connecting two elements by a wireless connection or by control signal cables which may be, for example, communication buses or multi-wire or single-wire cables, fiber optic cables, or Ethernet cables, for example, "etherCAT®".

Throughout this description, "endless flexible transmission element" comprises a belt or a link chain, among others, and the pulleys may comprise teeth or grooves for the coupling thereof in said flexible transmission element.

The scope of the present invention is defined by the following claims.

The invention claimed is:

1. A box forming machine for forming boxes of different shapes and sizes, comprising:

a support structure;

a forming station including an upper forming device and a lower forming device located above and below an operating space for forming a box in the operating space without horizontal movement of the box; and a plurality of glue application nozzles arranged for applying glue on inner or outer surfaces of upper transverse and longitudinal flaps of the box, and/or of lower transverse or longitudinal flaps of the box according to a predetermined path by a relative movement between the glue application nozzles and the box;

wherein the lower forming device comprises a plurality of lower flap folding devices facing one another in pairs, configured for folding lower transverse and longitudinal flaps of the box, to which glue was previously applied, from a vertical position to a horizontal position;

wherein the upper forming device comprises:

an upper vertical member, including a hold-down plate, movably by an actuator on a vertical path between a standby position outside the operating space and a working position within the operating space, placing the hold-down plate adjacent to the lower flap folding devices, to press the lower transverse and longitudinal flaps against the lower flap folding devices, and;

an upper folding device support movable along the vertical path between an inoperative position outside the operating space and an operative position within the operating space, or fixed in the upper forming device, and at least four folding devices facing one another in pairs, installed in the upper folding device support and operable for folding the upper flaps of the box, to which glue was previously applied, and pressing them against inner or outer surfaces of the side walls of the box; and wherein the relative movement between the glue application nozzles and the box is provided by at least the upper forming device, an auxiliary device, or a lower glue device of the forming station, wherein the machine further comprises:

a glue reservoir, integrating a reservoir heater for heating and melting glue, connected through flexible, pressurizable, and heatable glue conduits with hot glue injectors associated with a respective heating resistor and with a respective temperature sensor, the hot glue injectors being connected to a respective upper glue application nozzles and/or lower glue application nozzles of the plurality of glue application nozzles, a transverse and/or longitudinal positioning device of the glue injectors for moving and positioning the upper and/or lower glue application nozzles relocating the position of ends of the glue conduits, allowing changing the relative distance between glue injectors of the pair of glue injectors in different positions consistent with the dimensions of the box to be formed;

at least one electrically-operated valve associated with the hot glue injectors, configured for opening and closing a glue passage joining the flexible, pressurizable, and heatable glue conduits with the glue application nozzles, for applying the hot glue in respective relative positions of the glue application nozzles with respect to the box, according to operative parameters associated with the dimensions of the box to be formed, including dimensions of the upper flaps and lower transverse and/or longitudinal flaps and at least one working temperature of the hot glue previously input in a user interface, and a control device connected to the user interface configured for controlling at least the temperature of the glue in the reservoir, the conduits and the injectors, including a programmable control device connected to the actuator of said vertical member, and the control device being configured for receiving information about:

the reservoir heater;

the heating resistors; and the temperature sensors, wherein the programmable control device is connected to all parts imparting motion to the components of the machine, including upper and lower flap folding devices and the upper and/or lower glue application nozzles;

wherein the glue application nozzles are configured for applying the glue according to operative parameters indicative of at least one start and end glue application positions of the glue application nozzles; wherein a rotary motor and encoder are configured to provide the movement along the predetermined path aligned with a linear axis or with a vertical axis;

wherein position control parameters of the glue application nozzles and glue temperature control parameters are in play in the machine under the control of the control device; and wherein the upper folding devices are fixed in an alternating manner in the support structure.

2. The box forming machine according to claim 1, wherein the actuator of the upper vertical member comprises a rotary motor coupled to an encoder, the motor and encoder assembly being configured for moving the hold-down plate a desired linear length along the vertical path to a desired active and/or inactive position.

3. The box forming machine according to claim 1, wherein the control device comprises an electronic glue control device additionally configured for sending at least one change in an indicative signal from the temperature sensors to the programmable machine control device of the control device when the temperature sensors have reached the working temperature.

4. The box forming machine according to claim 1, wherein the plurality of lower glue application nozzles are supported in:

the lower glue device and are movable by at least one lower actuator of the lower glue device along the predetermined path aligned with a linear axis, or the upper vertical member or another upper vertical member of the upper forming device located in the forming station above the operating space and arranged relative to a vertical axis, which can be independently operated by another rotary motor in cooperation with a movement transmission mechanism so as to be moved on a path aligned with the vertical axis, the predetermined path is aligned with a linear axis parallel to the vertical axis, the lower glue application nozzles are configured for applying glue between the start and end positions, without horizontal movement of the box within the operating space; and wherein the flexible, pressurizable, and heatable glue conduits adapt the position of their outlet end towards the plurality of glue application nozzles consistent with the at least start and end glue application positions according to the predetermined path aligned with the linear axis.

5. The box forming machine according to claim 4, wherein:

the plurality of lower glue application nozzles are supported in the upper vertical member or the another upper vertical member, and wherein the lower glue application nozzles are associated with at least one electrically-operated valve and configured for applying glue on the upper flaps and the lower transverse or longitudinal flaps, according to operative parameters associated with the dimensions of the upper flaps and the lower transverse or longitudinal flaps previously input in a user interface.

6. The box forming machine according to claim 4, further comprising the plurality of upper glue application nozzles supported in the upper vertical member or the another upper vertical member of the upper forming device, and wherein the machine comprises at least two electrically-operated valves, at least one associated with the plurality of upper glue application nozzles configured for applying glue according to operative parameters associated with the dimensions of the upper flaps, and at least another one associated with the plurality of lower glue application nozzles and configured for applying glue according to operative parameters associated with the dimensions of the lower transverse and/or longitudinal flaps.

7. The box forming machine according to claim 1, wherein the plurality of lower glue application nozzles are supported in the lower glue device and arranged for applying glue on the outer or inner surfaces of the transverse lower flaps and/or longitudinal lower flaps, the machine further comprises the plurality of upper glue application nozzles fixed directly or indirectly in the support structure and arranged for applying glue on the outer or inner surfaces of the upper flaps, by a movement of a box according to a vertical path provided by the auxiliary device, and the machine comprises at least two electrically-operated valves, at least one associated with the plurality of upper glue application nozzles configured for applying glue according to operative parameters associated with the dimensions of the upper flaps, and at least another one associated with the plurality of lower glue application nozzles and configured for applying glue according to operative parameters associated with the dimensions of the lower transverse and/or longitudinal flaps.

8. The box forming machine according to claim 4, wherein the lower glue device comprises the lower actuator embodied in an auxiliary rotary motor and a power transmission mechanism coupled thereto, such that the plurality of lower glue application nozzles can be moved according to the path aligned with the linear axis which is at least vertical or horizontal, and further comprising an auxiliary encoder coupled to the auxiliary rotary motor, the motor and encoder assembly being configured for moving the plurality of lower glue application nozzles a desired linear length according to the path aligned with the linear axis, consistent with operative parameters indicative of at least one start and end glue application positions according to the path aligned with the linear axis.

9. The box forming machine according to claim 1, further comprising:

a positioning device including a gripping body provided with suction cups configured for holding at least one side wall of the box, a secondary rotary motor configured for moving the gripping body between one side of the operating space for the inlet of folded or unfolded boxes, and another position adjacent to another side of the operating space, for holding and placing an unfolded box with an essentially rhomboidal or rectangular configuration in the operating space of the forming station, a secondary encoder coupled to the secondary rotary motor, the secondary encoder and secondary rotary motor assembly being configured for positioning the side wall of the box in a desired position with respect to the vertical axis, consistent with at least one operative parameter of a position according to an auxiliary predetermined path input in the user interface, for adapting the machine to different sizes of box.

10. The box forming machine according to claim 9, further comprising:

a folded box storage area configured for receiving a plurality of boxes that are folded and stacked in the vertical position, and an unfolding and translation device which includes the positioning device, and wherein the gripping body provided with suction cups is supported by an arm connected to a carriage coupled along a transverse guide, the carriage being attached to an endless secondary flexible transmission element assembled on two secondary pulleys, one of which is coupled to a secondary reduction gear coupled to the secondary rotary motor configured for moving the gripping body between a position adjacent to the folded box storage area and a position adjacent to one side of the operating space opposite the folded box storage area, for holding a box of the folded box storage area, unfolding it and placing the unfolded box in an essentially rhomboidal or rectangular configuration in the operating space of the forming station, wherein the secondary encoder and secondary rotary motor are configured for translating the box transversely according to the auxiliary predetermined path aligned with a desired linear length, consistent with at least one operative parameter of a position along the transverse direction previously input in the user interface.

11. The box forming machine according to claim 1, wherein:

the upper forming device comprises four side bearing walls, two with front faces parallel to one another and two with side faces parallel to one another and perpendicular to the front faces, arranged around a path aligned with a vertical axis, and movable according to a path aligned with the vertical axis between a position within the operating space and a position outside the operating space, the side bearing walls being associated with at least one actuator configured for moving them according to a transverse and/or longitudinal direction, pushing from the inside of the box, between a contracted position in which the side bearing walls can be inserted into the box with an essentially rhomboidal or rectangular configuration, and an expanded position in which the box has a four-, eight-, or twelve-sided configuration.

12. The box forming machine according to claim 9, wherein the upper forming device comprises:

eight glue injectors each equipped with at least one of the glue application nozzles, each configured for applying glue on a respective upper flap of the box; and four other additional folding devices for folding upper flaps, each of which is intercalated between the four upper folding devices facing one another in pairs, the eight folding devices for folding upper flaps being arranged around the outer or inner part of the eight glue injectors with respect to a path aligned with the vertical axis.

13. The box forming machine according to claim 1, wherein:

at least one of the flexible, pressurizable, and heatable glue conduits is hydraulically connected at its proximal end to the reservoir and is hydraulically connected at its distal end to at least upper glue distributor;

a whole number of upper hot glue distributors, comprised between one and four, supported in the upper vertical member, the another vertical member, in the upper forming device, or in the support structure;

at least four auxiliary flexible, pressurizable, and heatable glue conduits, which hydraulically connect upper hot glue distributors with respective hot glue injectors of the plurality of glue application nozzles, are supported next to the glue injectors in the upper vertical member, the another vertical member, in the upper forming device, or in the support structure; and the flexible, heatable glue conduits occupy a central area centered with respect to a path aligned with the vertical axis, and the auxiliary flexible, heatable conduits extend from the central area towards the plurality of glue application nozzles located around the central area, demarcating it.

14. The box forming machine according to claim 13, further comprising:

a plurality of extension cords, each with a proximal end connected to the control device and a distal end connected to a respective auxiliary flexible, heatable conduit, configured for feeding the resistors and sensors of the auxiliary flexible, heatable conduits and the resistors and sensors associated with the glue injectors connected to the auxiliary heatable conduits; and wherein respective segments adjacent to the distal end of the plurality of extension cords are essentially vertical according to a path aligned with the vertical axis and are located around or in the central area.

* * * * *